US006820743B2

(12) United States Patent
Hurley et al.

(10) Patent No.: US 6,820,743 B2
(45) Date of Patent: Nov. 23, 2004

(54) SHIPPING PROTECTOR FOR BOTTLES OR THE LIKE

(76) Inventors: Richard D. Hurley, 3210 NW. McKinley Dr., Corvallis, OR (US) 97330; Richard B. Hurley, 2458 W. Maser Dr., Corvallis, OR (US) 97330

( * ) Notice: Subject to any disclaimer, the term of this patent is extended or adjusted under 35 U.S.C. 154(b) by 47 days.

(21) Appl. No.: 10/293,137

(22) Filed: Nov. 12, 2002

(65) Prior Publication Data

US 2003/0070951 A1 Apr. 17, 2003

Related U.S. Application Data

(63) Continuation of application No. 08/801,189, filed on Feb. 18, 1997, now abandoned, which is a continuation-in-part of application No. 08/607,781, filed on Feb. 27, 1996, now abandoned.

(51) Int. Cl.[7] ..... B65D 65/00; B65D 75/00

(52) U.S. Cl. ..... 206/427; 206/433; 206/499; 206/507; 206/518

(58) Field of Search ..... 206/203, 419, 206/420, 422, 427, 433, 499, 503, 507, 509, 511, 564, 518–520

(56) References Cited

U.S. PATENT DOCUMENTS

| | | | |
|---|---|---|---|
| 1,876,063 | A | 9/1932 | Kronenberger |
| 1,960,279 | A | 5/1934 | Read |

(List continued on next page.)

FOREIGN PATENT DOCUMENTS

| | | |
|---|---|---|
| FR | 1205747 | 2/1960 |
| FR | 2155005 | 5/1973 |
| GB | 857011 | 12/1960 |
| GB | 870704 | 6/1961 |
| IT | 596274 | 7/1959 |
| IT | 624839 | 9/1961 |

*Primary Examiner*—Luan K. Bui
(74) *Attorney, Agent, or Firm*—Dellett & Walters

(57) ABSTRACT

A shipping tray for bottles or other such fragile vessels suitably containing liquids therein employs a two-sided configuration with bottle receiving cradles and top and bottom stop members to prevent the bottle from sliding out of the tray. Shock absorbing members are provided about the perimeter of the tray, as well as a perimeter groove. Indentations at spaced locations on the tray perimeter function as shock absorbing spring members, and further allow displaced air to escape as the tray is lowered into a close fitting carton. The indentations further provide grip access to enable easy removal of a tray from within a close fitting carton. Both sides of a tray are functional, such that a series of trays may be packed with bottles with the trays in top side up or bottom side up configurations. A stack of trays nest together when not in use, for compact storage. When configured to receive wine bottles, the tray accepts multiple bottle shapes therein with adequate protection to each bottle style. The tray includes depressable stop members, which may be removed or depressed out of the plane of the bottle, to provide a longer bottle receiving portion. Multiple bottle configurations are thereby accommodated.

35 Claims, 20 Drawing Sheets

U.S. PATENT DOCUMENTS

| | | | | | |
|---|---|---|---|---|---|
| 1,967,026 | A | | 7/1934 | Gray et al. | |
| D155,932 | S | | 11/1949 | Shepard | |
| D160,738 | S | | 10/1950 | Randall | |
| 2,783,879 | A | * | 3/1957 | Emery | 206/499 |
| 2,863,595 | A | | 12/1958 | Emery | |
| 2,936,922 | A | | 5/1960 | Williams | |
| 3,261,531 | A | | 7/1966 | Barth | |
| 3,286,833 | A | | 11/1966 | Chadbourne | |
| 3,589,511 | A | | 6/1971 | Britt | |
| 3,608,706 | A | | 9/1971 | Vigue | |
| 3,715,853 | A | | 2/1973 | Bemiss | |
| 3,732,976 | A | | 5/1973 | Bessett et al. | |
| 4,241,830 | A | | 12/1980 | Di Gesu | |
| 4,298,156 | A | | 11/1981 | Reifers et al. | |
| 4,341,308 | A | * | 7/1982 | Pasquini | 206/427 |
| 4,427,730 | A | | 1/1984 | Robbins et al. | |
| 4,792,045 | A | | 12/1988 | Creaden | |
| 4,840,276 | A | | 6/1989 | George | |
| 5,096,650 | A | | 3/1992 | Renna | |
| 5,127,526 | A | | 7/1992 | Vigue | |
| 5,259,508 | A | | 11/1993 | Beckerman | |
| 5,335,770 | A | | 8/1994 | Baker et al. | |

* cited by examiner 148
146
144
132
48
118
116
114
110
108
80
74
72
70
68
66
63
60
64
58
56
140
142
54
52
50
43
42
18
46
40
134

SHIPPING PROTECTOR FOR BOTTLES OR THE LIKE

RELATED APPLICATIONS

This application is a continuation-in-part of U.S. patent application Ser. No. 08/607,781, filed Feb. 27, 1996 now abandoned, which is a continuation-in-part of Ser. No. 08/607,781, filed Feb. 27, 1996, now abandoned.

BACKGROUND OF THE INVENTION

It is often desirable to ship bottles or other vessels, typically containing liquids. However, the typical shipping environment is replete with situations that can result in damage to the vessels and their contents. In the wine industry, for example, especially in the high end product lines or in gift packaging industries, it is common practice to ship wine typically in packs of one, two, three, four, six or twelve bottles, in a corrugated carton with some type of protection to prevent the bottles from becoming broken and spilling their contents during shipping.

Heretofore, in the shipping of wine, expanded polystyrene packaging material has been used as a shipping protector wherein different configurations are employed to provide top, middle and bottom layers for maintaining the bottles in spaced relation to one another. The bottles are typically provided in groups of two, three, or four bottles per horizontal layer. For example, a standard three bottle configuration has a bottom protecting expanded polystyrene part "A", three bottles positioned therein, a separating center expanded polystyrene protector "B" positioned on top of the bottles, sometimes in an interlocking relation with the "A" part, a second layer of bottles positioned on top of the "B" part and finally a third top portion (denoted "C") which engages with the top portion of the "B" part as well as the top layer of bottles. While certainly providing a fine job of packing performance, such expanded polystyrene protectors have several drawbacks. First, because the various expanded polystyrene pieces fit together in only one configuration, the amount of storage space required for maintaining inventory of the various packing components is large. The parts do not nest together to provide a compact storage format and accordingly take up the same volume in storage prior to use as would be required for a fully configured carton with wine bottles therein. Thus, storage problems exist, especially for a wine retailer who does not desire to devote extensive space to storage, since each square foot of space devoted to storage reduces space available for inventory or product display. A further issue with respect to the expanded polystyrene type packaging materials that employ "A" and "B" or "A", "B" and "C" configurations is inventory maintenance. It becomes difficult to control the inventory of "A", "B" and "C" components since not every shipment will use all three portions. A shipment of one layer of bottles, for example, will likely use an "A" and a "C" part, while a shipment of two layers of bottles uses an "A", one "B" and one "C" part. A shipment of three or four bottle layers would use one "A", two or three "B" and one "C" part. Accordingly, it becomes difficult to predict how many of each item should be kept in inventory.

Other wine bottle package inserts employ an A/B configuration wherein the two parts form a clam-shell type package such that each layer of bottles requires an A and a B part to completely surround the bottles. Such protectors, whether made of expanded polystyrene or of molded pulp fiber, typically employ a bottle engaging geometry configuration on one face thereof and support surfaces on the opposite side such that in order to properly pack and protect a row of wine bottles, two such protectors are positioned around the bottles with the bottle engaging geometries of the two protector pieces face-to-face and the support foot side of each protector piece facing outwardly with respect to the bottles. Accordingly, in order to pack two layers of bottles in a shipping carton, four bottle protector inserts are required. To pack four bottle layers in a carton, eight such protector inserts are required. Minimizing shipping weight is an issue in packing, so the need for two shipping protectors per layer can undesirably increase the shipping cost as the number of bottles per shipping carton increases.

With the various "A", "B" and "A"/"B"/"C" configuration packs, it becomes critical during loading of the shipping carton that the particular A and B parts (and/or C parts) be oriented correctly both with respect to top to bottom and left to right orientation within the package in order to ensure that the bottles and packing fit perfectly within the carton. This can slow down throughput in high volume shipping operations, since the packer must carefully orient the packaging insert to ensure that it is of the correct orientation prior to beginning the packing process.

A further disadvantage to standard expanded polystyrene type protectors is that they are less environmentally friendly than protectors of molded fiber, which are typically made from recycled paper and themselves can be recycled into reclaimed waste paper stock. The expanded polystyrene type protectors are difficult to recycle and do not easily biodegrade. Therefore, the trend is toward use of recycled and recyclable materials for protectors. One such material is molded fiber, especially molded paper pulp. However, while it is possible to devise an expanded polystyrene protector with two functional sides, allowing an "A" only configuration and reducing inventory problems, it becomes difficult to provide protectors with two functional sides thereto when employing molded pulp, since unlike with expanded polystyrene, which allows shapes on one side of an item to be formed without interfering with the second side (given a protector of sufficient thickness), the nature of molded pulp items results in the three-dimensional structures of one side of an item having a non-negligible three-dimensional effect on the reverse side of the item. For example, a valley on one side of a molded fiber article forms a corresponding hill on the other side of the article. Accordingly, it has heretofore been impractical to employ molded fiber protectors for bottles or the like with two functional sides thereto.

In accordance with the prior art, rib portions of shipping protectors have heretofore been formed as a rib feature extending from a boundary plane of the protector. For example, a rib or other feature extends from the top plane or web of the protector, downwardly to a position defining the rib bottom and back upwardly to the top plane of the protector. Each such rib feature has heretofore been isolated from other adjacent rib structures, by the web of the protector.

Another concern with prior art protectors is that when a number of the empty protectors are stacked in a nested configuration for shipping or storage, the protectors tend to become rather tightly engaged with each other, making their separation difficult. This is especially true if the stack is dropped or otherwise subject to vibration or impact during shipping, for example. The tight engagement and the attendant degree of difficulty in separating the individual protectors can slow down the packing of articles by the ultimate end user, as a worker must take a relatively great deal of time to separate the individual protectors from each other prior to use.

In the wine industry, there are four bottle types which are predominantly used in 750 ml volume configurations, Riesling/hock style bottles, Chardonnay/Burgundy style bottles, champagne punt bottles and Bordeaux style bottles. The Riesling/hock bottle has a more elongated neck and provides a relatively smooth transition from the body of the bottle through the neck. The Chardonnay/Burgundy bottle is of a slightly quicker transition between the body of the bottle and the neck portion so as to have a less elongate appearance than the Riesling/hock bottle. Also, the Riesling/hock bottle is typically somewhat taller than the Chardonnay/Burgundy style bottle. The Bordeaux bottle is substantially the same height as a Chardonnay/Burgundy bottle but rather than employing a relatively concave transition from the body of the bottle through the neck, it has a convex transition portion into a substantially cylindrical shaped neck. The Champagne bottle is a low shoulder profile (fat) bottle. In accordance with wine bottle shipping packs of the prior art, one or more of the four major bottle shapes may not fit in the packing in firm engagement, allowing the bottle to shift back and forth excessively during movement of the carton which may result from the carton being picked up and set down or because of vehicle movement during transportation, which can increase the likelihood of damaging the bottle, or the label. Some wine labels are made from uncoated label stock and are easily subject to scuffing.

While the above mentioned bottle sizes have heretofore been predominantly used, as competition in the wine industry increases, wine makers are more frequently employing more uniquely shaped bottles to package their product. More unique bottle shapes help to distinguish the particular brand of wine at the retail sales point, and help the wine to stand out and increase its likelihood of catching the eye of the consumer. These non-standard size bottles do not always fit well into prior art bottle shipping protectors.

Wineries and wine retailers also may want to send one or two bottles to a customer, for example a member of a wine club or a restaurant, or to a wine reviewer or critic (in the case of a new wine vintage for example).

The International Safe Transit Association (ISTA) has defined a series of test procedures for determining performance of shipping protection systems, known as ISTA Project 1A. The ISTA preshipment test procedures provide a means for a manufacturer to predetermine the probability of the safe arrival of his packaged products at their destination through the utilization of tests developed to simulate the shocks and stresses normally encountered during handling and transportation. Project 1A is intended for packages weighing less than 100 pounds (45.36 kgs). The test procedures are subdivided into two portions, the vibration test and the drop test. For the vibration test, the packaged product is placed on the vibration tester in the position in which the product is normally shipped. The vibration frequency is set at the minimum speed sufficient to cause the packaged product to leave the table momentarily such that a metal shim, 1/16th of an inch thick and approximately 2 inches wide, may be inserted at least 4 inches between the bottom of the packaged product and the vibration table surface. The packaged product is then vibrated for a total of 14,200 vibratory impacts. After one-half of the vibration has been accomplished, the package is rotated horizontally 90°. For the drop test portion of the procedures, packages up to 20.99 pounds are dropped free fall from 30 inches, while packages through 40.99 pounds are dropped 24 inches. A series of ten drops then takes place, beginning with a drop on a corner formed by the right side, bottom and near end of the package. The remaining nine drops are as follows:

(2) the shortest edge radiating from that corner.

(3) the next longest edge radiating from that corner.

(4) the longest edge radiating from that corner.

(5) flat on one of the smallest faces.

(6) flat on the opposite small face.

(7) flat on one of the medium faces.

(8) flat on the opposite medium face.

(9) flat on one of the largest faces.

(10) flat on the opposite large face.

After the tests have been performed, the packaged product shall be considered to have satisfactorily passed the test if upon examination, the product is free from damage and the container still affords a reasonable protection to the contents.

Molded fiber wine bottle protectors in accordance with the prior art do not provide the survivability to pass these rigorous testing standards, increasing the likelihood that a wine shipment could arrive at its destination with one or more bottles damaged, for example, bottles broken, labels or capsules scuffed or corks pushed, causing leakage. In addition, actual field trial testing is required to ensure that the product will be successfully protected as it moves through the transportation environment.

SUMMARY OF THE INVENTION

According to an embodiment of the invention, a bottle shipping protector comprises a tray-like apparatus with a top "screened" face and a bottom "textured" face. Both faces are provided with functional shapes to operate in stacking engagement with bottles to provide impact protection while maintaining separation of the bottles (in multi-bottle configurations). A series of bottle receiving cradles are provided to engagingly receive multiple bottle shapes therein, with a bottle bottom stop member, a bottle top stop member and crush zones thereabout to progressively fail under impact for absorbing the shock of such impact and thereby protect the bottles against breakage. An adjustment member is provided which enables alteration of the length of the bottle receiving portion of the tray, to allow the protector to accommodate a greater variety of bottle sizes.

It is therefore an object of the invention to provide an improved protector for absorbing shock for protecting a fragile shipped article.

It is another object of the present invention to provide an improved bottle shipping protector that employs a two-sided functional arrangement.

It is a further object of the present invention to provide an improved wine bottle shipping tray that requires minimal storage space when not in use.

It is still a further object of the present invention to provide an improved shipping tray for bottles that passes UPS, Federal Express and ISTA Project 1A testing requirements.

It is yet another object of the present invention to provide an improved bottle shipping pack that accepts at least the four different standard 750 ml wine bottle shapes as well as most others.

It is another object of the present invention to provide an improved two-sided bottle shipping tray that minimizes the required number of trays per package.

It is yet another object of the present invention to provide an improved bottle shipping tray that works for top, middle and bottom layer applications in multi-layer packages.

It is a further object of the present invention to provide an improved bottle shipping tray that is recyclable and/or is made from recycled material.

It is still another object of the present invention to provide an improved wine bottle shipping tray that nests with other such trays for compact storage.

It is yet a further object of the invention to provide an improved bottle shipping tray that keys off of features of a bottle for stacking layers of bottles and trays.

It is still a further object of the present invention to provide an improved shipping protector that contours and flexes with impact to reduce shock to well below the damage boundary/fragility level of a given product.

It is a further object of the present invention to provide an improved shipping protector that provides protection not just on the first impact, but blow after blow.

It is another object of the present invention to provide improved shipping protectors that enable two or three item shipments in the same size carton.

It is still another object of the present invention to provide an improved shipping protector that enables shipping of bottles in one bottle, two bottle, three bottle or multiples of one, two or three bottle configurations with a single style protector.

Another object of the present invention is to provide an improved shipping protector that is adaptable for multiple bottle configurations.

A further object of the present invention is to provide an improved shipping protector that employs depressable cushioning stops which can be moved so as to be out of the way of longer bottles.

Another object of the present invention is to provide an improved bottle shipping protector that is adaptable to receive short or long bottles therein.

It is a further object of the present invention to provide an improved shipping protector that has variable length stop members.

Another object of the invention is to provide an improved shipping protector that employs removable stop members that may be left in place for articles of one size and which may be removed or pressed out of the way to accommodate articles of greater length.

Yet another object of the present invention is to provide an improved shipping protector that can be shipped or stored in a nested configuration yet is easily de-nested.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
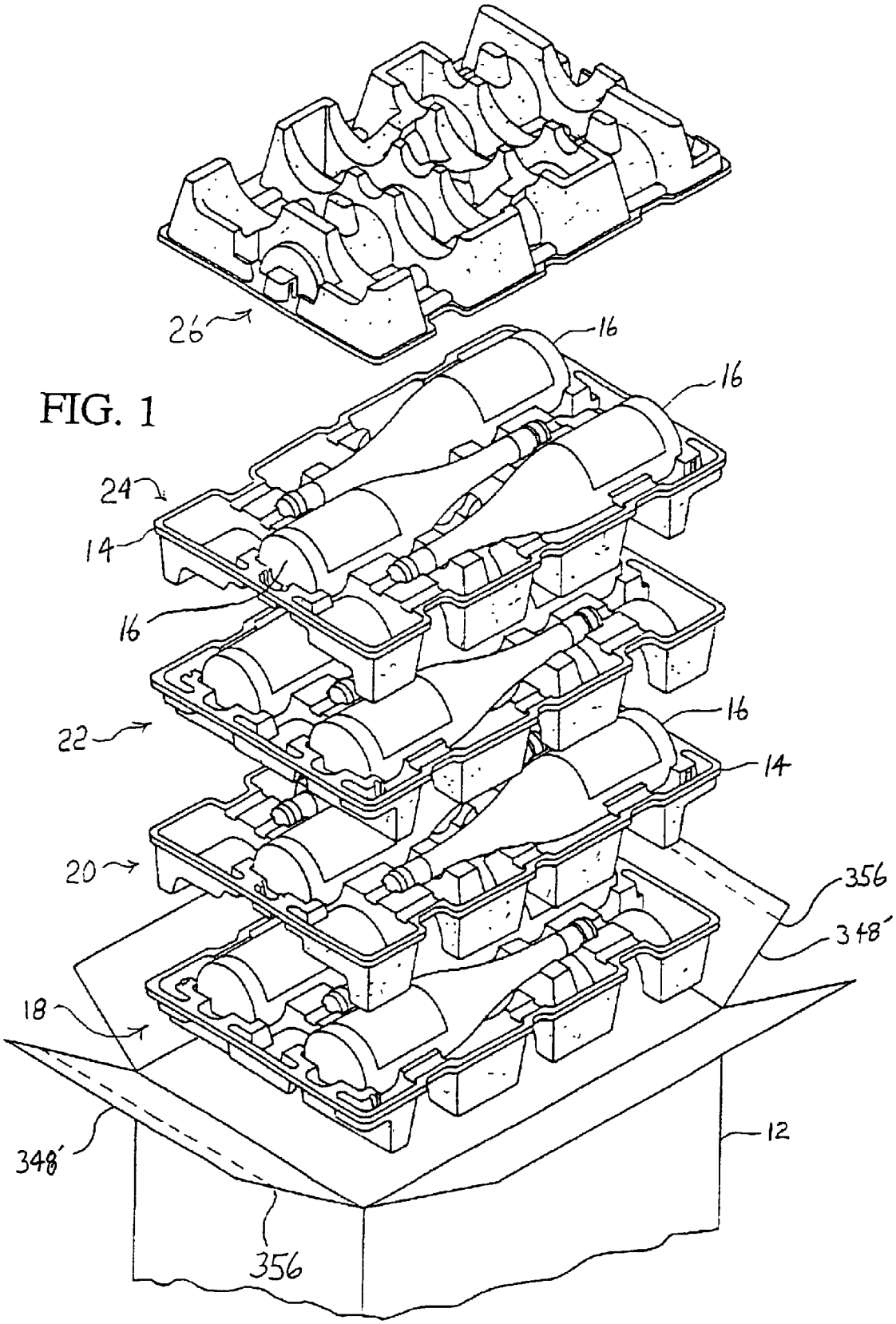
FIG. 1 is an exploded perspective view of a carton of twelve bottles of wine as packaged with the protector tray of the present invention.

Referring to FIG. 1, an exploded perspective view of a typical packaging arrangement according to the present invention, a carton 12, suitably a corrugated carton, receives a series of wine pack trays 14 therein, each tray suitable for holding wine bottles 16 therein. In the illustrated embodiment, a given tray 14 receives three bottles therein, with the bottles positioned substantially horizontally and arranged in alternating orientation with respect to the tops and bottoms of the bottles. In a preferred embodiment, when manufactured of molded fiber, the tray has distinct top and bottom configurations, wherein the "top" screened side of the tray is relatively smooth in appearance (compared to the bottom textured side) and the "bottom" side is somewhat more roughened in texture. The screened/textured surface configuration is mainly a result of the process employed in forming the trays wherein the screened tray face has been formed against the face of a mold and the textured face has remained substantially free of a mold thereagainst for at least a portion of the forming process. In packing, the tray is preferably positioned with the top face of the tray oriented upwardly for each layer from the bottom-most tray layer 18, as well as for subsequent tray layers 20, 22 and 24. However, it will be noted that the design of the tray allows for the top face of the tray to be in either upward or downward orientation without increasing the overall height of the finished packing configuration. Each subsequent tray layer 20, 22 and 24 is rotated 180 degrees in a horizontal plane relative to the tray immediately therebelow, such that the wine bottles accordingly alternate with two bottle tops oriented to a first direction (e.g. right) on a given layer and one bottle top pointing a second directions (e.g. left). The next tray layer up has two bottles pointing the second direction (e.g. left) and one bottle oriented to the first direction. The top-most layer 26 fits over the uppermost layer of bottles, on top of tray layer 24, oriented in a flipped fashion with respect to the vertical plane, such that trays 24 and 26 form a "clam-shell" type configuration with respect to the bottles of that layer, with the top faces of both trays oriented towards the bottles. For shipping, the tray layers are placed within carton 12 in the manner noted hereinabove, and the carton is sealed in any suitable manner (e.g. by application of water activated reinforced kraft tape along the seam at the top of the carton and at least partially down the sides of the carton adjacent thereto). An individual bottle 16 may suitably be wrapped with tissue paper prior to placement within a shipping tray to provide added protection against scuffing of the label on the bottle. The tissue wrapping may further be of a bright color (or otherwise decorated) to provide an aesthetically pleasing appearance. Further, the tray is suitably provided with a pleasing color to match or complement most wine bottle labels as typically employed, for example purple or violet, by dyeing during manufacturing. In a preferred embodiment, a violet dye is employed to give a rich color to the tray for a bright presentation, by employing Michler's ketone free dyes, particularly Basazol™ violet 45L or Basazol™ violet 49L from BASF of Mount Olive, N.J.

Figure 2:
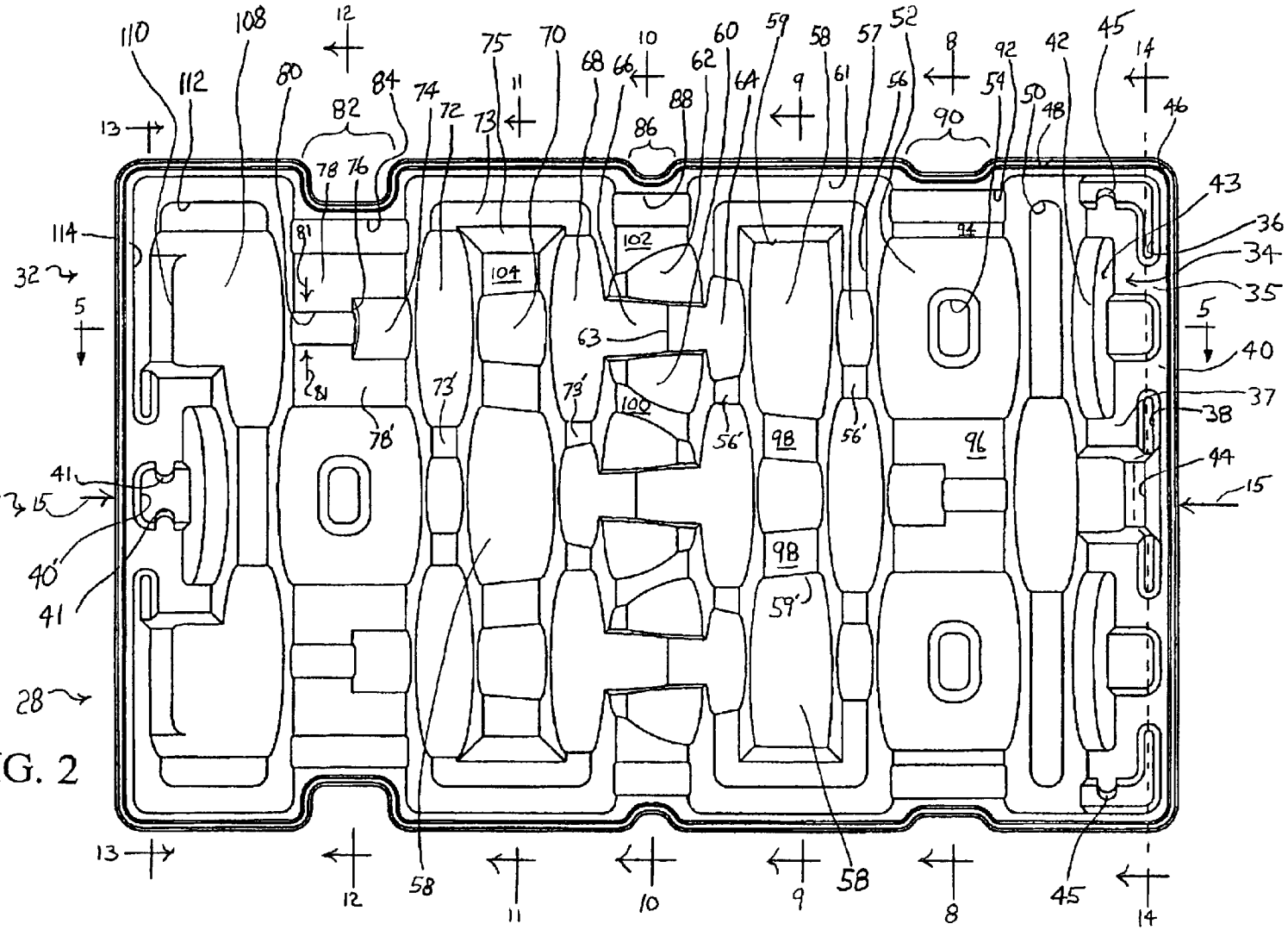
FIG. 2 is a top plan view of a single protector tray for receiving three wine bottles therein according to the present invention.

Referring now to FIG. 2, which is a top plan view of a single protector tray 14, it is observed that the tray comprises three bottle receiving bays 28, 30 and 32 positioned side by side, such that the neck of a given bottle in bay 30 will be held adjacent and between the bottom portions of the bottles in bays 28 and 32. Similarly, the necks of bottles in bays 28 and 32 will have the bottom portion of the bottle in bay 30 therebetween. The tray is bilaterally symmetrical along center line 15—15 of FIG. 2. Each bottle bay has features corresponding to those of any other bay, so the structure of the three bays may be understood by considering a single bottle bay 32, wherein protection to the bottle against damage is provided by bottle base zone crush protector 34, which comprises first and second substantially "z"-shaped members 35 and 37, with shallow well portion 36 formed adjacent the top and side portions of member 35, shallow well portion 38 formed adjacent the side portion of member 37, and central shallow well portion 40 defining the space between members 35 and 37. The shallow well portions extend downwardly between one fourth and one third the height of the tray (defined as the distance between the plane of the top portion of the tray and the bottom portion of the tray, suitably comprising slightly more depth than the maximum depth of a wine bottle). A relatively deep semi-circular bottle receiving end stop 42 is defined between members 35 and 37, positioned with central well portion 40 centrally thereof. The top faces of members 35 and 37 define a plane, which will bisect the body of a typical 750 ml wine bottle when the bottle is received within the tray with the bottom portion of the bottle within bottle receiving end stop 42. Accordingly, the depth from the top face of member 34 and the bottom most position of end stop 42 is one half of the depth of a typical 750 ml wine bottle. The bottle bottom rests against face 43 of the end stop 42, defining the rearward limit of movement of the bottle with respect to the tray. An intermediate depth well 44 extends downwardly into the plane of the tray beyond the end of shallow well portion 38, to a depth intermediate the depth of portion 38 and the depth of stop 42. Tray perimeter portion 46 defines a rim lip substantially around the entire tray perimeter, with a shallow depth "U" shaped channel 48 defined therein.

Adjacent end stop 42, trough 50 is formed and extends downwardly at an angle to a flat bottom at a plane below the plane of base crush protector 34, defining the floor or lowermost portion of tray 14. The trough wall then extends upwardly at an angle whereby hemispherical bottle cradle 52 is defined, providing an arcuate member that is concave upwardly for closely engaging the body of a wine bottle. Central hollow 54 is formed substantially centrally of cradle 52, extending downwardly in tapered fashion to the floor plane of the tray and employs a flat bottom portion of rectangular dimensions. Beyond the edge of cradle 52 distal from trough 50 is a flat bottom trough 56 with concave down central hump 57 centered along section line 5—5. Secondary bottle cradle 58 is also concave upwardly and defines a somewhat hemispherical bottle receiving portion with its floor angling slightly upwardly along the section line 5—5 in the direction extending away from cradle 52. The floor of trough 56 is co-planar with the floor of trough 50 and extends in a "U" shape around outer side 59 of cradle 58, while two smaller somewhat square shape flat bottom portions 56' are positioned at either side of the base of cradle 58 near the inner edge 59' thereof. Outer tray wall 61 extends from the floor of trough 56 upwardly to perimeter rim portion 46 at a fairly steep angle (approximately 80 degrees). The outer edge 59 of cradle 58 is truncated and does not extend up to meet the level of the top plane of the tray, while inner edge 59' does extend up to meet the plane of the tray top, defining a surface 98. Left and right bottle shoulder cradles 60 and 62 are positioned further along section line 5—5 from cradle 58, with a central trough defined between the left and right cradles. Cradles 60 and 62 are concave upwardly and narrow as they become more distal from cradle 58. A trough saddle portion 64 is defined between cradle 58 and cradles 60 and 62, and is concave down. The upper most portion of saddle 64 falls below the plane of the nadir of cradle 58, and extends angled upwardly to a position 63, whereupon a second saddle 66 of more pronounced upward concavity is formed, smoothly transitioning into saddle 68, which is essentially hemispherical and concave downwardly, suitably defining the shape of the upper body portion of a wine bottle. Neck/capsule cradle 70 is positioned in spaced relation to cradles 60 and 62, with saddle 68 defining the space therebetween. Neck/capsule cradle 70 is concave upwardly and narrows slightly as it extends away from saddle 68, providing a receiving member for the neck or capsule of a wine bottle. Another saddle 72 of substantially hemispherical shape is adjacent the distal edge of neck cradle 70, and is concave downward in the shape of the body of a wine bottle. A substantially flat bottomed trough 73 extends in a truncated "U" shape co-planar with troughs 50 and 56 around outer side 75 of neck cradle 70, with two smaller essentially square shaped flat bottom portions 73' positioned at either side of the base of cradle 70 at the inner edge thereof and also co-planar with trough 73. Bottle top cradle 74, spaced from cradle 70 by saddle region 72, defines a hemispherical region with a diameter corresponding to the outer diameter of a typical 750 ml wine bottle top.

The distal wall 76 of top cradle 74 forms a vertical wall, to define the forward limit of movement of the bottle with respect to the tray by engagement with the top surface of the bottle (should the bottle move forward to such a position). To either side of cradle 74 are truncated-"L"-shaped regions 78, 78', with a shallow crushable channel 80 extending from the distal end of cradle 74 and between the two regions 78 and 78'. Channel 80 acts to absorb shock and deform in the directions of the arrows 81 in FIG. 2.

The tray perimeter steps inwardly in a wide "U" shape area 82 near the region 78, with a shallow crushable channel 84 defined between region 78 and the outer tray perimeter. A somewhat shallower and narrower inward step 86 is formed in the tray perimeter adjacent cradle 62, with a shallow channel 88 between the perimeter at region 86 and the top surface 102 of cradle 62. Surface 102 is somewhat wedge shaped and lies in the plane of the tray top. A step 90 is formed at the tray perimeter near cradle 52, having similar depth to that of step 86, but being substantially as wide as step 82, with a shallow channel 92 formed adjacent thereto. A thin flat surface 94, co-planar with surface 102, is between channel 92 and cradle 52, extending along the outer edge of the cradle. Channel 92 functions in a corresponding shock absorbing manner to channel 80. The inward step configurations at 82, 86 and 90 provide spring like shock absorbing function, such that the tray flexes somewhat on impact and returns substantially to its original shape without structurally failing. Accordingly, a tray in accordance with the present invention advantageously allows elastic deformation of the tray somewhat returning to its original shape. Heretofore, molded fiber type protectors were subject to plastic deformation and typically were unable to spring back to their original shape or some equivalent thereof.

The features at 82, 86 and 90 also allow displaced air to escape as a tray is lowered into a carton, ensuring ease of packing. Further, the indentations at 82, 86 and 90 define access regions to enable a finger, for example, to be placed underneath the tray while the tray is sitting within a carton, for ease of removal of the tray layer from the carton. Without such indentations, it can be difficult to remove tray layers from a carton, especially the lower layers, since the trays typically fit in close engagement to the walls of a carton.

Extending on in the tray beyond channel 80 is another hemispherical saddle 108 that is substantially co-planar with saddle 72, with an end indentation 110 therein extending at least partially downward towards the floor plane of the tray. Floor trough 112 extends adjacent the outer edge of saddle 108, wherein tray end wall 114 defines the distal end of the tray. An inverted "Z" shaped surface member 116, co-planar with the top plane of the tray, extends inwardly from the distal edge of the tray, with a narrow trough 118 formed at a portion thereof between the tray perimeter and a leg of member 116, defining a crushable region. Trough 118 is suitably deeper than channel 80, but not as deep as indentation 110. A well portion 40', corresponding the well 40 of bay 32, is defined adjacent member 116. Well 40' is bisected by the tray center line 15—15.

The various surfaces at 37, 56', 78, 78', 94, 96, 98, 100, 102, 104, 106 and 116 all define essentially flat co-planar surfaces, along with portions of the perimeter of the tray, to function as feet or the like when another tray is placed atop this tray, or if this tray is placed on a surface face down.

Bottle bay 30 is formed adjacent bottle bay 32, with corresponding features, but oriented 180 degrees out of phase in the horizontal plane with respect to bay 32. Bay 28 is oriented in the same direction as bay 32, adjacent the distal edge of bay 30, such that bay 30 is between bays 28 and 32.

Figure 3:
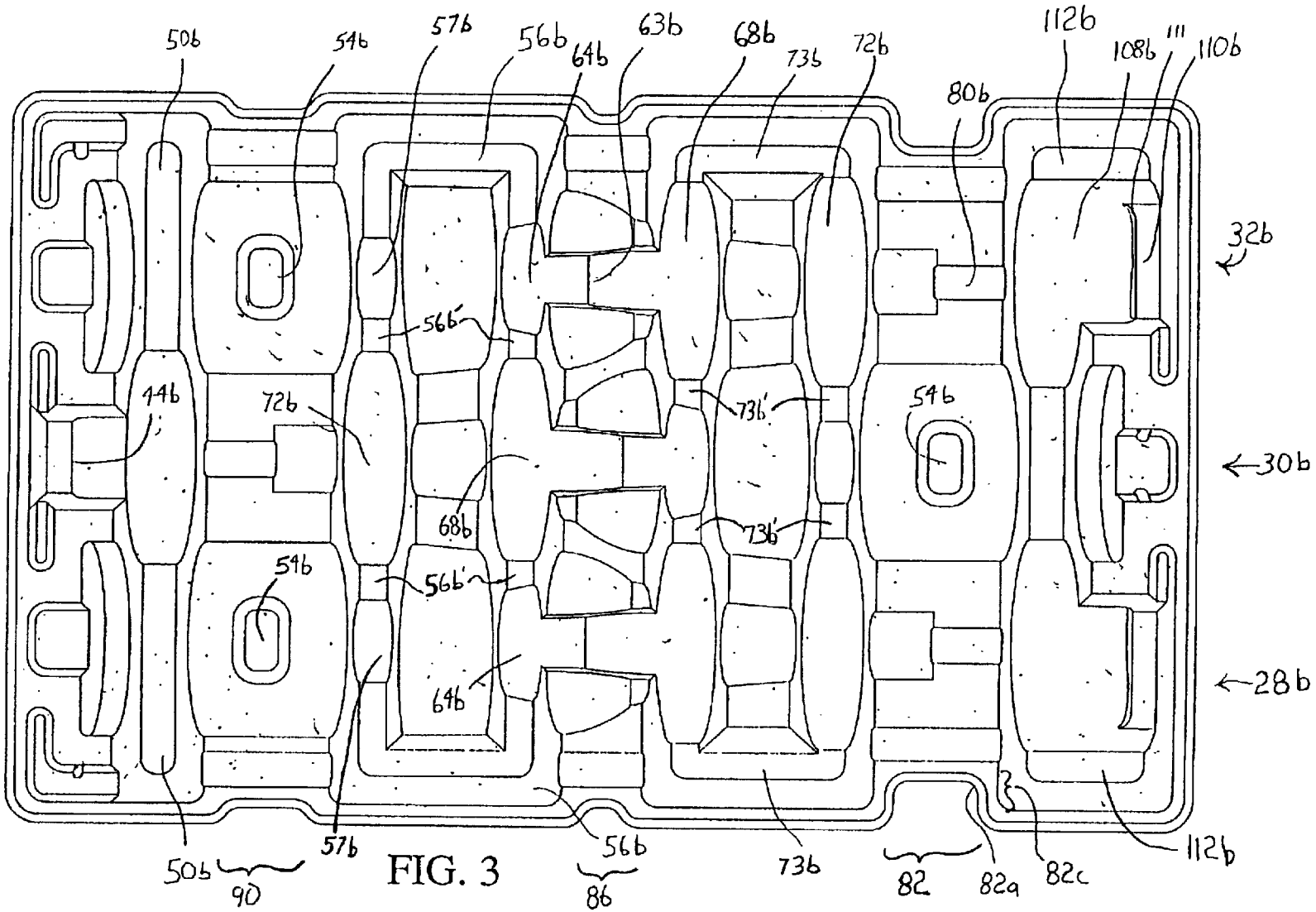
FIG. 3 is a plan view of the bottom portion of the wine bottle shipping protector of FIG. 2.

FIG. 3 is a bottom side view of tray 14 of FIG. 2, and has corresponding features thereon to many of the features of the top side, including three bottle bays 28*b*, 30*b* and 32*b*. An advantage is provided by the tray of the present invention since the features of the bottom side of the tray also interact with bottles to protect and prevent substantial movement of the bottles during shipping of multi-layer bottle packages. Accordingly, referring to bottle bay 32*b*, the tray bottom employs a bottle top stop member 54*b*, formed as a protruding post resultant from the back side of the formation of central hollow 54 on the tray's front side. A bottle neck/capsule cradle 57*b* defines a hemispherical cradle to receive a portion of the bottle neck or capsule. Cradle 57*b* is formed by the back side of central hump 57 on the tray front. A bottle shoulder engaging hump 63*b* protrudes slightly upwardly, as a result of the change of inflection at position 63 on the front face of the tray. First and second bottle cradles 68*b* and 72*b* define hemispherical cradles of a depth equal to the radius of a typical 750 ml wine bottle. Features 68*b* and 72*b* are fashioned as the by-products of saddles 68 and 72 on the tray front side. Bottle end receiving cradle 108*b* provides a hemispherical well that receives the bottom portion of the bottle, wherein bottle stop 110*b*, formed as the inverse of the tray front end indentation 110, employs a face 111 to engage the bottom of the bottle to prevent the sliding exit of the bottle from the tray. Stop 110*b* extends approximately one-fourth to one-third the radius of a typical 750 ml wine bottle. Bay 30*b* employs a bottle end stop member 44*b* at one end thereof, formed as the counterpart to intermediate depth well 44 (FIG. 2) on the top face of the tray. Stop member 44*b* defines a hump that engages the bottom of a bottle to prevent a bottle in bay 30*b* from sliding out of the tray.

Foot members are defined on the bottom of the tray near the left and right perimeters at one end thereof, by features 112*b*, as counterparts to the floor troughs 112 on the opposite face of the tray. Further, the outer faces of the bottle top stop members 54*b* define foot members that are co-planar with features 112*b*. Other foot members which are substantially co-planar with features 112*b* and members 54*b* are 73*b* and 73*b*′, formed as counterparts to troughs 73 and 73' on the tray's top face and members 56*b* and 56*b*′, formed by troughs 56 and 56' of the opposite tray face. U-shaped members 56*b* of bottle bays 28*b* and 32*b*, members 56*b*′ and the cradle members 57*b*, 64*b*, 68*b* and 72*b* together define a rectangular structural frame. Similarly, members 73*b* in bays 28*b* and 32*b* and members 73*b*′ together with the cradle members 68*b*, 72*b*, 64*b* and 57*b* therebetween, also define a rectangular frame.

Many of the various structures of the protector according to the present invention are formed as ribs within ribs, wherein, for example, a product receiving feature on one face of the protector arises out of a portion of a product receiving feature on the other face of the protector. For example, referring to FIG. 2 and FIG. 3, concave upwardly secondary bottle cradles 58 in bays 28 and 32, edges 59', surfaces 98 and neck/capsule cradle 70 (bay 30) of FIG. 2 are formed as a rib which arises out of flat bottom trough 56, square shape flat bottom portions 56', concave down central hump 57 and concave down trough saddle portion 64. When considered from the face of FIG. 3, the back side of cradle 58 forms a concave down saddle bordered by upwardly extending U-shaped member 56*b*, members 56*b*′ and the trough portions defined by cradle 57*b*, cradle 64*b*, cradle 68*b* and cradle 72*b*. As noted hereinabove, U-shaped members 56*b* of bottle bays 28*b* and 32*b*, members 56*b*′ and the cradle members 57*b*, 64*b*, 68*b* and 72*b* together form a structural frame, which may be considered as a rectangular rib member. Cradle 58, edges 59', surfaces 98 and cradle 70 are suitably formed as a rib defined within the structural frame rib member. Similarly, the rectangular rib frame formed by members 73*b* in bays 28*b* and 32*b* and members 73*b*′ together with the cradle members 68*b*, 72*b*, 64*b* and 57*b* therebetween, also have saddle shaped members 70 of bays 28 and 32 and cradle 58 of bay 30 on the screened face of FIG. 2 defined therein as ribs within ribs. Having the various cradles on each face of the protector be suitably concave in directions opposite to each other and defined as ribs within ribs assists in providing structural integrity to the protector, reducing the likelihood that the protector will collapse in accordion like fashion in response to impact. Additionally, the rib within a rib features provide resistance to warping along the longitudinal axis of the bottle bays during manufacturing of the protector.

Other structural advantages are apparent, referring to FIG. 3, wherein member 80*b*, for example, forms a lateral thrust absorbing stiffener, wherein whereupon impact the stiffener will resist against collapse or hinging of the tray in the direction of the impact, The spring member portions at 82, and to a lesser degree at 86 and 90, will tend to collapse somewhat on impact, whereupon given sufficient impact the spring member will fracture or tear at position 82*a* illustrated in FIG. 3, providing elasticity to the tray allowing flexing of the end portion of the tray to absorb the impact, and allowing the subsequent return to at least an approximation of the original shape. The region indicated at 82*c* will also fold into the wider portion of the spring member wherein the corner at 82*a* acts somewhat as a hinge as does the corner portion distal therefrom towards the perimeter, so that the region at 82*c* folds into the open region 82 somewhat.

The various hemispherical or arch shaped portions of the protector provide further advantages in that they are strong (e.g., similar to egg shape) and provide progressive failure, rather than a failure profile that quickly transitions between no failure and total failure modes. The arched members on the top face define counterpart arched voids on the bottom face of the tray that are suitably able to collapse and otherwise absorb shock.

Figure 8:
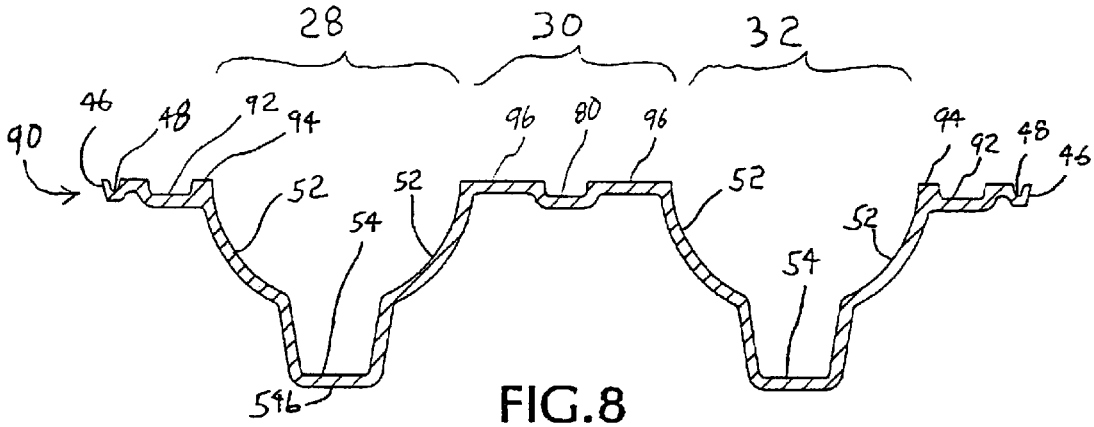
FIG. 8 is a cross sectional view of the protector of FIG. 2 taken along line 8—8.
Figure 9:
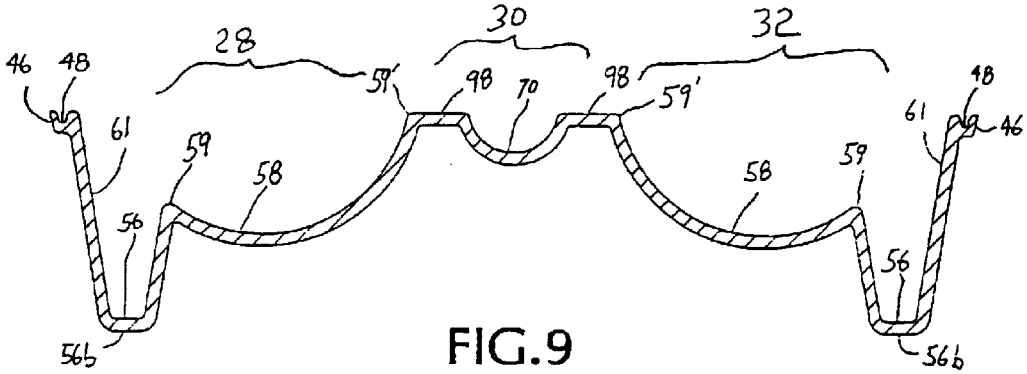
FIG. 9 is a cross sectional view of the protector of FIG. 2 taken along line 9—9.
Figure 10:
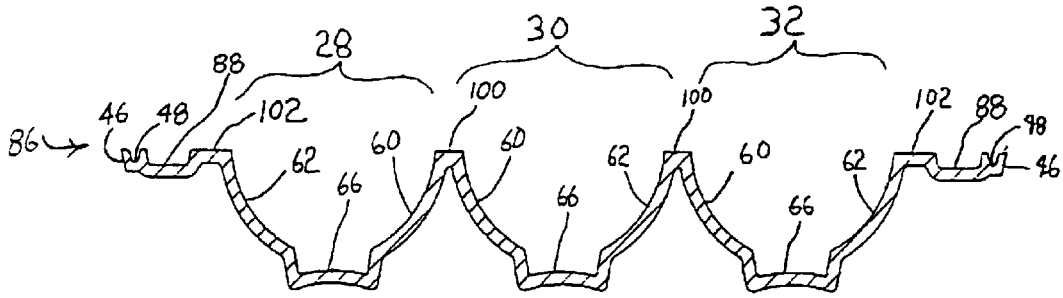
FIG. 10 is a cross sectional view of the protector of FIG. 2 taken along line 10—10.
Figure 11:
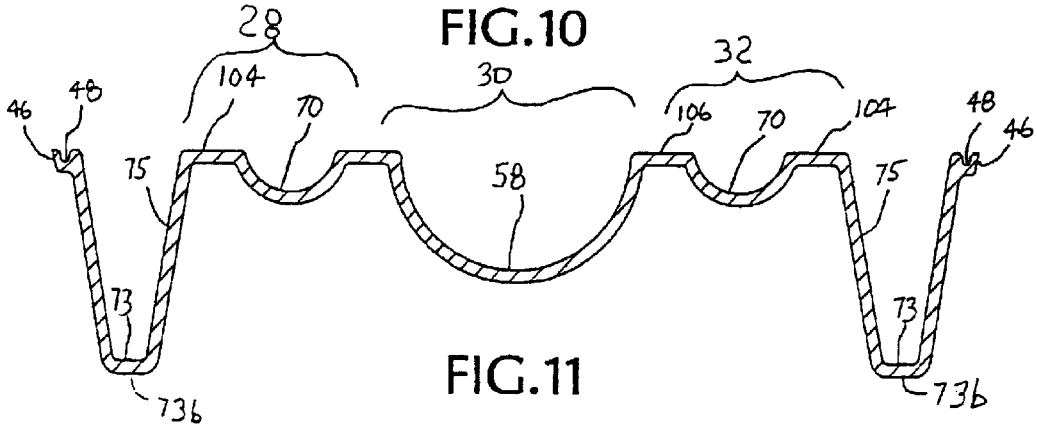
FIG. 11 is a cross sectional view of the protector of FIG. 2 taken along line 11—11.
Figure 12:
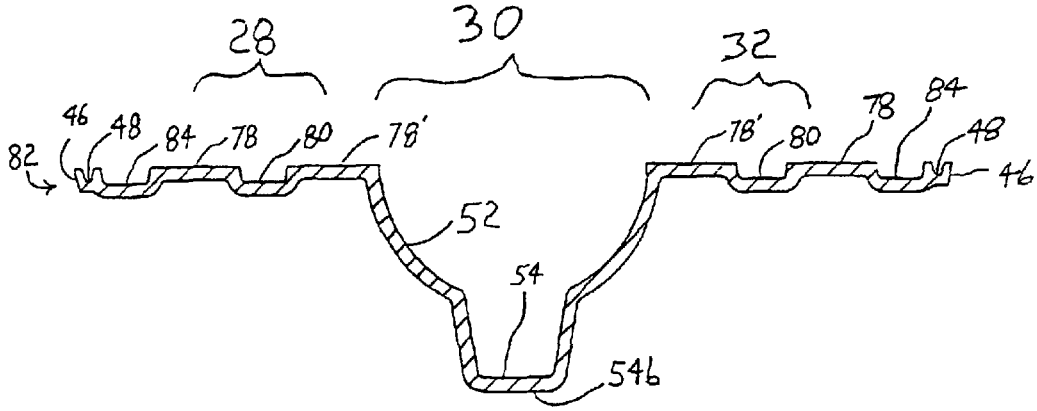
FIG. 12 is a cross sectional view of the protector of FIG. 2 taken along line 12—12.
Figure 13:
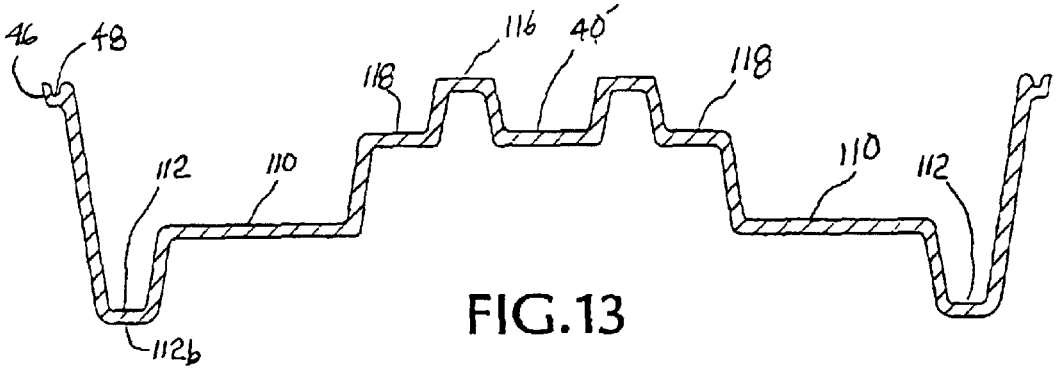
FIG. 13 is a cross sectional view of the protector of FIG. 2 taken along line 13—13.
Figure 14:
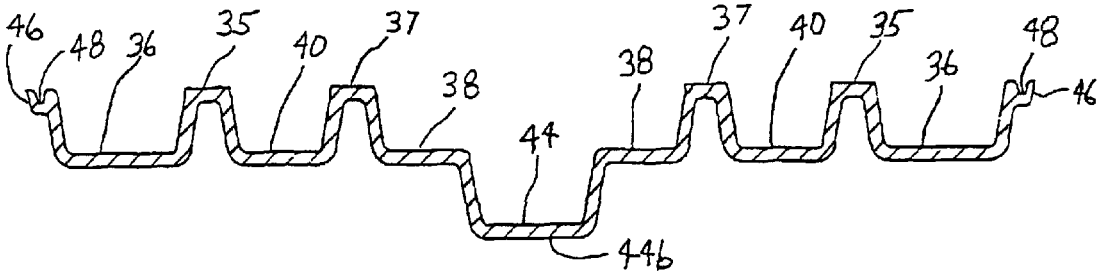
FIG. 14 is a cross sectional view of the protector of FIG. 2 taken along line 14—14.

The shape profile of various tray features are further illustrated in cross section by FIGS. 8–14. FIG. 8 is a cross sectional view of the protector taken along line 8—8 of FIG. 2, wherein the hemispherical shape of bottle cradle 52 may be appreciated, as well as the relative depths of channels 80 and 92. FIG. 9, a cross sectional view of the protector taken along line 9—9 of FIG. 2, illustrates in greater detail the configuration of full height tray wall or perimeter flange 61 at either edge of the tray. The full height flange is useful because it maintains the packing depth to be uniform, whether the tray is oriented face up or face down, so that in packing, a multiple layer configuration will always pack at the same height, whether the trays are oriented upwardly or downwardly, ensuring that the overall packing configuration will fit within its carton. It would be highly undesirable to discover that, having inadvertently oriented one tray in the wrong orientation, the layers would now be too high to fit and have the carton close properly therearound. Accordingly, the present tray provides advantages not apparent in accordance with the prior art. The partially truncated portion of bottle cradle 58 at outer side 59 thereof in bays 28 and 32 is also apparent. This shape should be contrasted with cradle 58 of bay 30 as illustrated in cross section in FIG. 11, as noted hereinbelow. The cross sectional view of the protector taken along line 10—10 of FIG. 2 is shown in FIG. 10, wherein bottle shoulder cradles 60 and 62 define an increasingly narrower channel therebetween in each bottle bay when extending further towards the bottle top. Channel 88 provides crushable shock absorption, similar to channel 80 discussed hereinabove. Referring to FIG. 11, a cross sectional view of the protector taken along line 11—11 of FIG. 2, as alluded to hereinabove, cradle 58 of bay 30 does not employ a truncated shape at one edge thereof, since bay 30 is in the central portion of the tray and does not have trough 56 and wall 61 formed adjacent thereto. FIG. 12, a cross sectional view of the protector taken along line 12—12 of FIG. 2, shows the crushable channels 80 and 84 of bays 28 and 32 and bottle cradle 52 of bay 30. FIG. 13, a cross sectional view taken along line 13—13 of FIG. 2, illustrates the relative depth and shape profiles of indentations 110, floor troughs 112, troughs 118, member 116 and well 40'. With reference to FIG. 14, a cross sectional view of the tray taken along dashed line 14—14 of FIG. 2, the relative depth and profiles of well 44, shallow well portion 38, well 40 and shallow well portion 36 are further illustrated, as well as the height of surfaces 35 and 37.

When viewed from above as in FIG. 2, the saddle portions 57, 64, 66, 68, 72 and 108 of the tray suitably define the nominal shape of a bottle that would typically be received by the tray. Similarly, when viewed from the bottom side (FIG. 3), the back sides of the various cradle portions 52, 58, 70 and 74 define the nominal shape of a typical 750 ml bottle.

Figure 5:
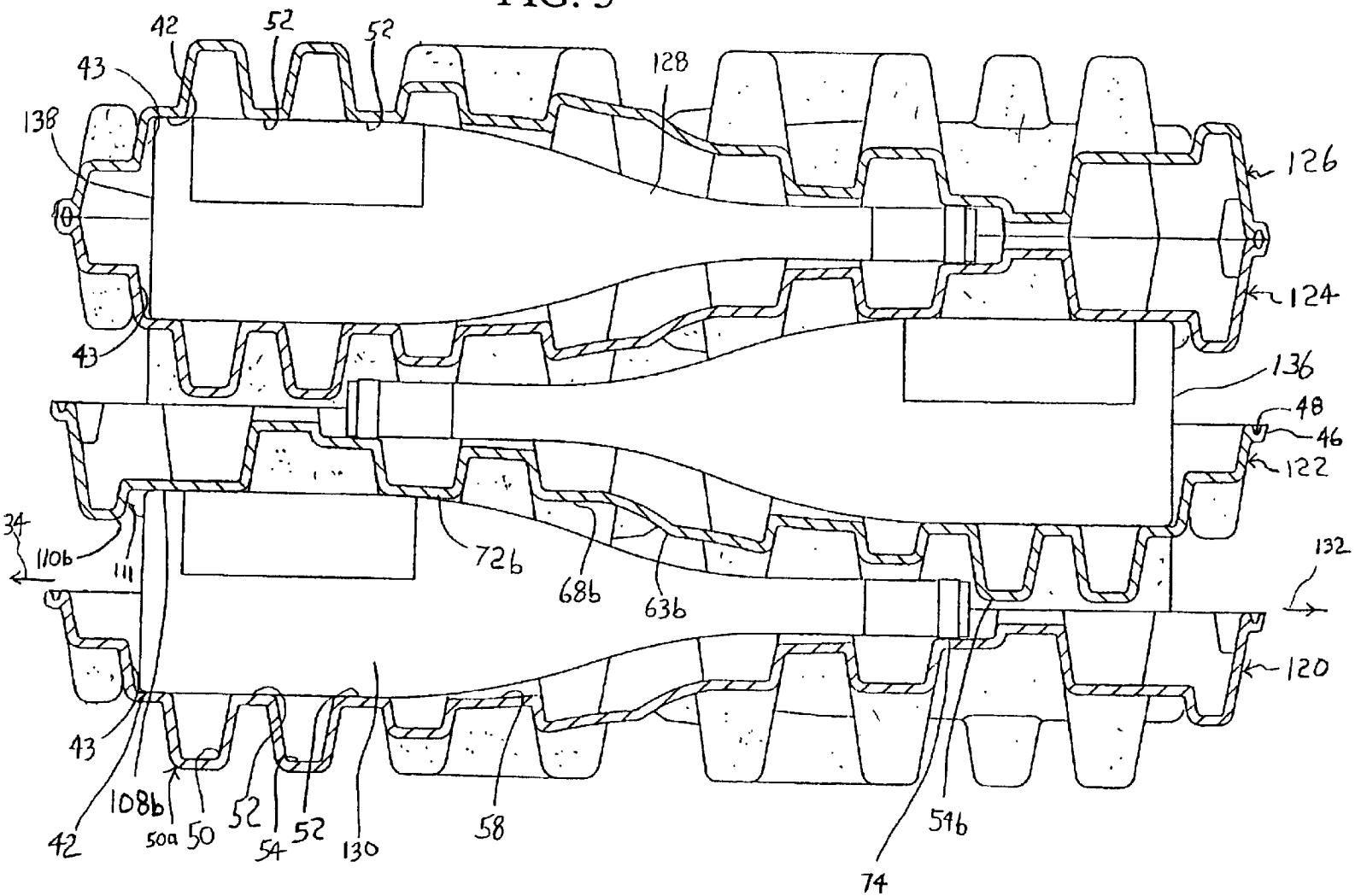
FIG. 5 is a side sectional view of a three layer arrangement employing four shipping protectors according to the present invention with three layers of Riesling/hock style wine bottles therein, wherein the sections of the protectors are taken along line 5—5 of FIG. 2.

Referring now to FIG. 5, a side sectional view of a three layer arrangement employing four shipping protectors according to the present invention with three layers of Riesling/hock style bottles therein, a typical use configuration of the tray according to the present invention is illustrated. For a three layer configuration with three bottles per layer, four trays are employed: bottom tray 120, in a top-side-up orientation; first mediate tray 122 which rests in a top-side-up orientation above tray 120, but 180 degrees out of phase in the horizontal plane; second mediate tray 124 on top of tray 122, also in a top-side-up orientation 180 degrees out of phase with tray 122 (thus in phase with tray 120); and top tray 126 oriented top-side-down over tray 124. The top and second mediate trays 126, 124 provide a clam-shell like configuration to surround and contain wine bottle 128 therein. It should be noted that the preferred orientation of the trays is as illustrated herein, with all but the top most tray positioned in top face up fashion. However, in accordance with the present invention, the tray is advantageously functional in any arrangement of tray configurations (top/bottom wise) such that configurations with the tray bottom face oriented upwardly also function to protect the bottles therein.

In the illustration of FIG. 5, Riesling/hock style bottles are packed within the series of trays. Referring to the bottom most bottle 130 in tray 120, the end portion of the bottle abuts against face 43 of bottle receiving end stop 42, and is thereby prevented against rearward movement out of the tray. Face 111 of stop 110*b* on the bottom face of tray 122 engages the upper portion of the bottom of bottle 130, further assisting in preventing the bottle from sliding out of the tray in the direction of arrow 134. Cradle 52 of tray 120 receives the bottle therein, while as a result of the taper of this particular bottle style, cradle 58 does not substantially touch the bottle. The upper side of the bottle's body is contacted in hemispherical fashion by bottle end receiving cradle 108*b* at the bottom side of tray 122. Second bottle cradle 72*b* on the bottom side of tray 122 engages a portion of the body of bottle 130, providing further support thereto. The head of the bottle rests on bottle top cradle 74 of tray 120, and also abuts (or nearly abuts) bottle top stop member 54*b* on the bottom of tray 122. The resulting interaction of the bottle with structures 74 and 54*b* provides a stop beyond which the bottle will not travel in the direction of arrow 132 of FIG. 5. The frictional engagement of the bottle cradles to the bottle will further assist in discouraging sliding of the bottle back and forth in the tray.

A similar interaction is had between bottle 136 at the next layer up and the top face of tray 122 and the bottom face of tray 124. Note however that the trays 120, 122 and 124 are positioned in alternating left/right fashion, and subsequent layers of bottles are oriented in alternating left/right directions relative to the bottle layer immediately therebelow. The top most bottle layer, consisting of bottle 138, rests on the top face of tray 124, and is encompassed at the top portion of the bottle by tray 126, oriented in a top face down configuration, resulting in a clam-shell style arrangement that protects the top bottle. Tray 126 interacts with bottle 128 in essentially a mirror image fashion to the interaction of the bottle with tray 124.

Figures 4, 6, 7:
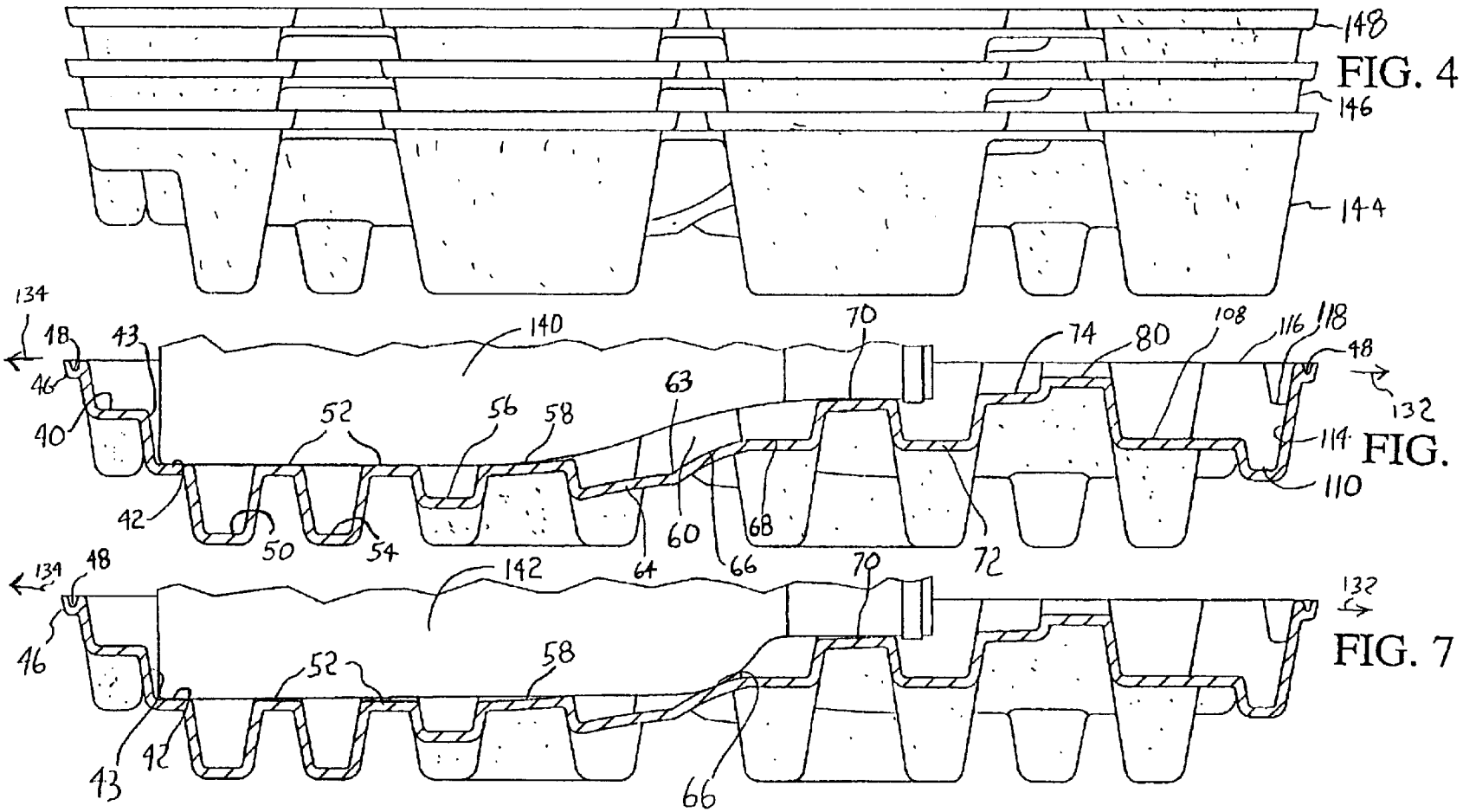
FIG. 4 is a side view of three shipping protectors according to the present invention illustrating how the trays stack together in nested relation for storage or shipping prior to use.
FIG. 6 is a side sectional view of a shipping protector according to the present invention with a Chardonnay/Burgundy style wine bottle therein, wherein the section of the protector is taken along line 5—5 of FIG. 2.
FIG. 7 is a side sectional view of a shipping protector according to the present invention with a Bordeaux style wine bottle therein, wherein the section of the protector is taken along line 5—5 of FIG. 2.

FIG. 6 is a side sectional view of a shipping protector according to the present invention with a Chardonnay/Burgundy style wine bottle therein. The section of the protector is taken along line 5—5 of FIG. 2. The Chardonnay/Burgundy bottle 140 is received by the tray in a corresponding fashion to the manner in which the Riesling/hock style bottle is received therein. The Chardonnay/Burgundy style bottle has a taller body portion and shorter neck, and accordingly is substantially fully supported by cradle 58 (as contrasted with the Riesling/hock style bottle which typically does not rest against cradle 58). However, bottle 140 is typically somewhat shorter than bottle 130, for example, and therefore does not extend completely to portion 74 of the tray. However, as bottle 140 moves forwardly in the tray in the direction of arrow 132 in FIG. 6, the increasing narrowness of the opening in bottle shoulder cradles 60 and 62 (cradle 62 is not visible in FIG. 6) will result in wedging of the bottle therebetween to define a movement stop position, so that further movement of the bottle in not possible in the direction of arrow 132.

Referring now to FIG. 7, a side sectional view of a shipping protector according to the present invention with a Bordeaux style wine bottle therein, wherein the section of the protector is taken along line 5—5 of FIG. 2, the interaction of the tray with the third major wine bottle style may be observed. The Bordeaux bottle 142 rests in cradle 52 and at least partially in cradle 58, with the neck and capsule of the bottle being received by neck cradle 70. The bottle's shoulder interacts with saddle 66 and ensures against significant movement of the bottle in the direction of arrow 132. As the bottle tends to move in the direction of arrow 132, it will begin to ride up on shoulder 66, which is concave upwardly, causing the bottle to wedge more tightly against the next tray up, either against the shoulder 66 of the upper tray in a clam-shell type configuration where the upper and lower trays are oriented "top face to top face" or against bottle shoulder engaging hump 63*b* of the upper tray in the case of a "top face to bottom face" configuration of the lower and upper trays. It will be understood that if the lower tray is oriented with its bottom face up, the bottle shoulder will interact with hump 63*b* of the bottom tray in a corresponding manner.

It will also be understood that the cross-sectional profile of the various structures as visible in FIG. 5, for example trough 50, wherein the trough has a somewhat narrower base and flares to a wider upper end thereof, as well as the somewhat rounded corners 50*a* thereof, provide a failure profile that will result in a gradual crushing of the structure on impact. This gradual failure profile contributes to the shock absorbing qualities of the tray.

As noted hereinabove, typical expanded polystyrene trays are not configured to enable storage in any configuration other than the full volume configuration, resulting in excessive storage space requirements. In accordance with the tray of the present invention, a series of trays may be stored in a nested configuration, as illustrated in FIG. 4, wherein a series of three trays 144, 146 and 148 are stacked one atop the other, with each tray top face up and oriented in the same direction in the horizontal plane. Accordingly, partially as a result of the tapered shape of the features of the trays, subsequent tray layers fit down within the tray layer below resulting in a compact vertical space requirement. Significant space savings are thereby realized in storage, wherein, for example, 30 stacked trays will nest together to only 21 inches in height, approximately one-third the space required for a corresponding number of expanded polystyrene type trays.

When a number of trays are so stacked, in order to ensure relative ease of separation of the trays for use, anti-nesting members 41 and 45 are suitably provided to tray 14. Anti-nesting members 41 comprise left and right protruding members positioned at the left and right sides of central shallow well portion 40. Anti-nesting members 45 comprise protruding members formed in members 35 at the left and right sides of the tray 14 adjacent shallow well portions 36. Members 41 and 45 extend from the top surface of the protector to the bottom of their respective shallow well portions and suitably protrude slightly into the well. The anti-nesting members provide an interference with adjacent protectors to define a stop point beyond which nesting of the protectors is inhibited to thereby prevent excessively deep nesting.

While the above example is directed to a wine bottle shipping tray, other articles, bottles or vessels may be suitably received by a shipping tray according to the present invention with attendant modifications to the shapes of the saddles and cradles and adjustment of the overall tray height, width and length to accommodate items of different diameters, lengths and cross sectional profiles. Further, while the illustrated embodiment employs a three bottle per tray configuration, one, two or more than three bottle tray configurations are also suitably within the scope of the invention.

A further advantage provided by the tray is that it may also accommodate non-standard bottle sizes. For example, by omitting every other bottle in a given layer, it is possible to accommodate six non-conforming bottle shapes in a five tray configuration that would normally hold twelve conforming bottles. This packaging is accomplished by, for example, placing the non-conforming bottle on a first layer in the center bay and firmly pushing the bottle into the bay, which will likely deform the various structures of that bay into the bays adjacent thereto. However, no bottles are placed in the bays adjacent the center bay for this layer, so impact protection is still provided without the likelihood that the bottles will contact each other. The next layer employs the two non-conforming bottles in the outer bays, with the central bottle bay left vacant. The walls of the alternate non-utilized cavities can be partially deformed or otherwise deflected by the non-standard size bottle, without worry of striking or contacting bottles in the vacant cavities. Four bottle layers in total are employed with one bottle in the first layer, two in the second, one in the third and two in the fourth, and then the top tray providing the top level protection. The embodiments of FIGS. 20–25 as discussed hereinbelow are also adapted to non-standard size articles.

Figure 15:
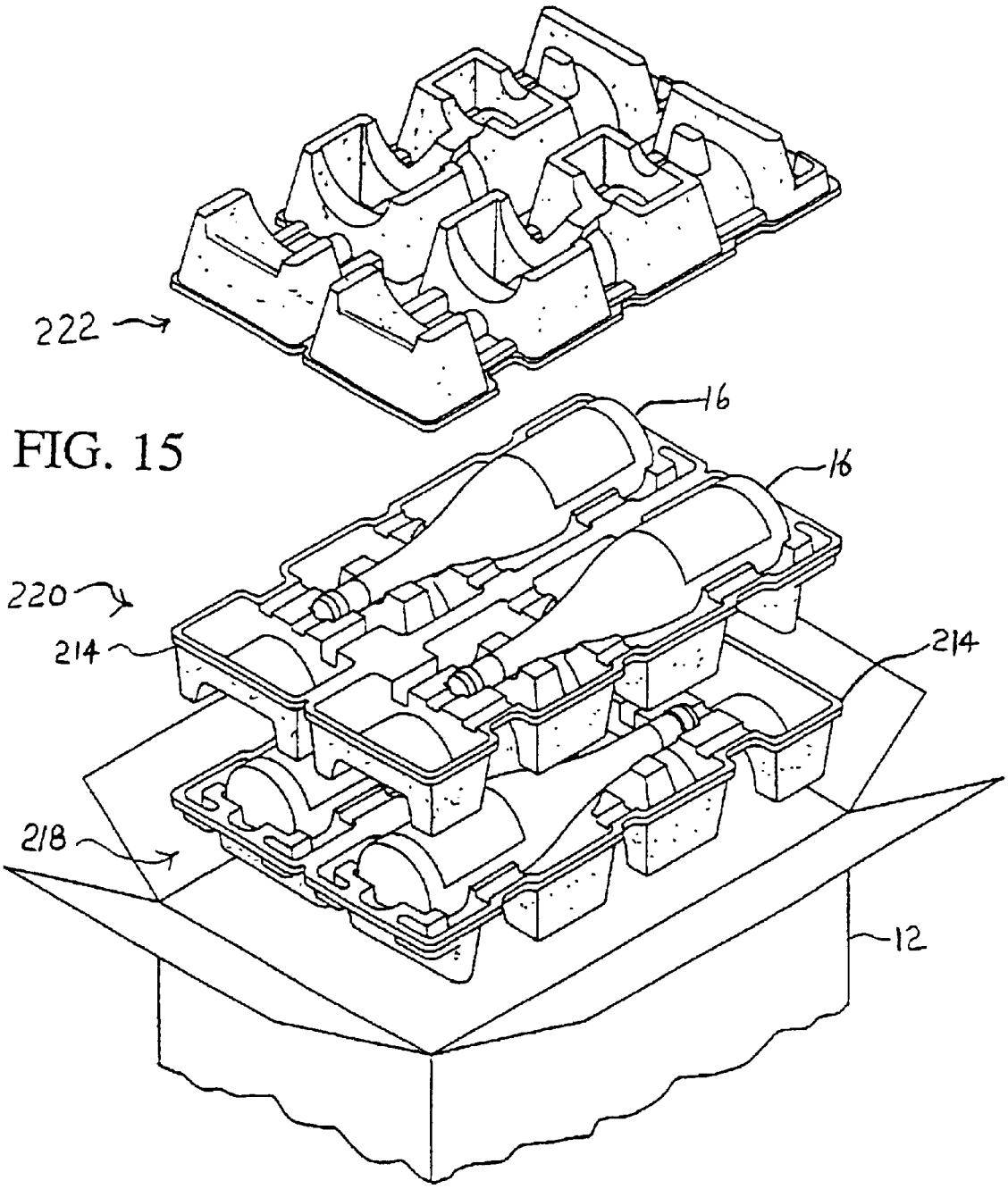
FIG. 15 is an exploded perspective view of a carton of four bottles of wine as packaged with a second protector tray according to the present invention.

Referring now to FIG. 15, an exploded perspective view of a carton of four bottles of wine as packaged with a second protector tray embodiment, the carton 12, which suitably has the same footprint as carton 12 of FIG. 1, receives plural protector trays 214 therewithin, wherein the lower tray layers each hold two bottles 16 therein. The bottles 16 are in side by side relation to each other, suitably oriented with the corks pointing the same direction. In corresponding fashion to the embodiment of FIG. 1, in packing, the tray is preferably positioned with the top (or screened) face of the tray oriented upwardly for each layer from the bottom-most tray layer 218, as well as for subsequent tray layers 220, although the protector will function with either face oriented upwardly. The design of the tray allows for the top face of the tray to be in either upward or downward orientation without increasing the overall height of the finished packing configuration. Each subsequent tray layer is rotated 180 degrees in a horizontal plane relative to the tray immediately therebelow, such that the wine bottles accordingly alternate with the bottle tops oriented to a first direction (e.g. right) on a given layer. The next tray layer up has its bottles pointing the second direction (e.g. left). In the four bottle configuration shown in FIG. 15, the top-most layer 222 fits over the uppermost layer of bottles, on top of tray layer 220, oriented in a flipped fashion with respect to the vertical plane, such that trays 220 and 222 form a "clam-shell" type configuration with respect to the bottles of that layer, with the top faces of both trays oriented towards the bottles. For shipping, the tray layers are placed within carton 12 in the orientation noted hereinabove, and the carton is sealed in any suitable manner. An advantage provided by the tray of the second embodiment is that it has perimeter dimensions that correspond to those of the three bottle tray of FIG. 1, enabling, for example, stocking of a single carton 12 for either three or two bottle tray shipping configurations. Therefore, a wine dealer can ship either two or three bottle packages of wine by using either tray 14 or tray 214 while stocking only a single size carton, reducing the carton inventory requirements and also increasing buying capacity while providing flexibility of shipments sizes.

Figure 16:
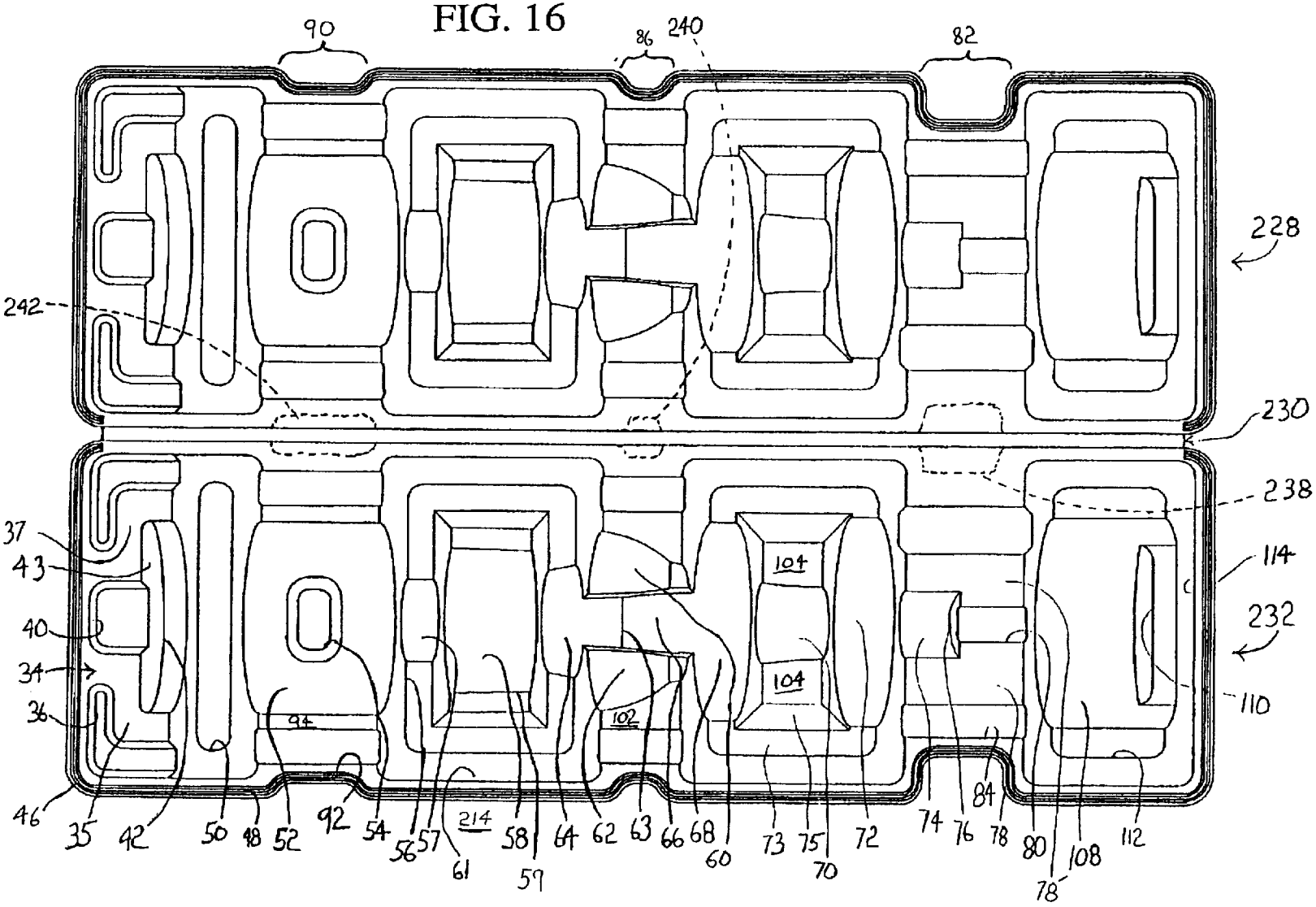
FIG. 16 is a plan view of the second embodiment of the protector in the open state.
Figure 18:
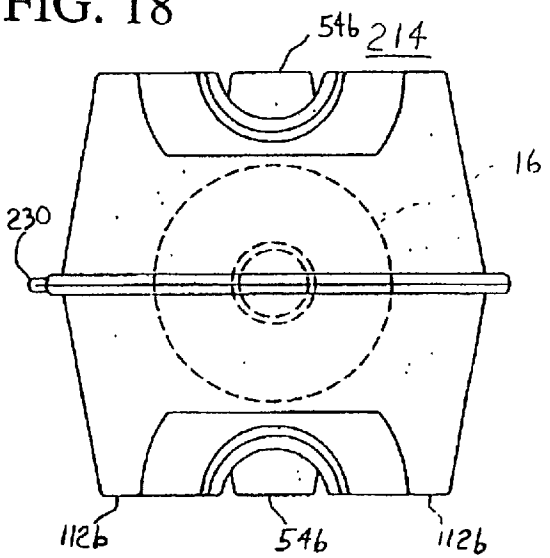
FIG. 18 is an end view of the protector of FIG. 17 in a closed state.
Figure 17:
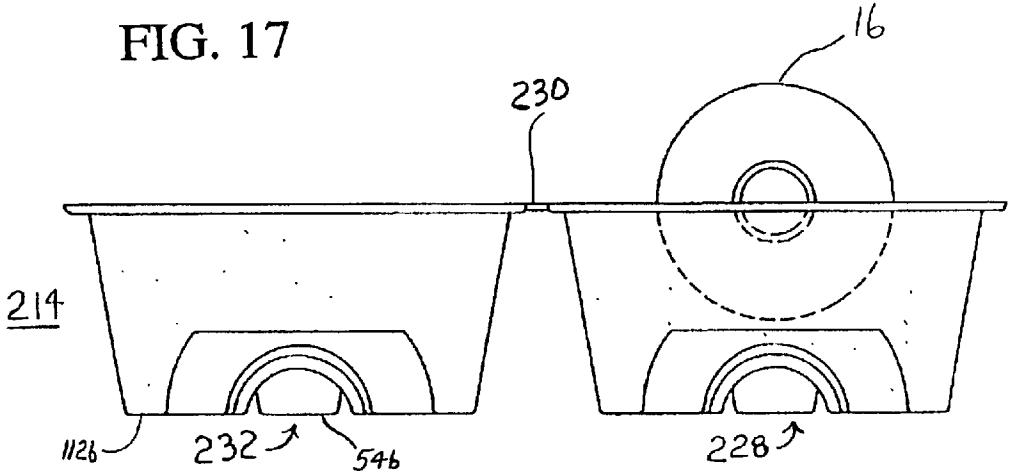
FIG. 17 is an end view of the second embodiment of the protector tray in an open state.
Figure 19:
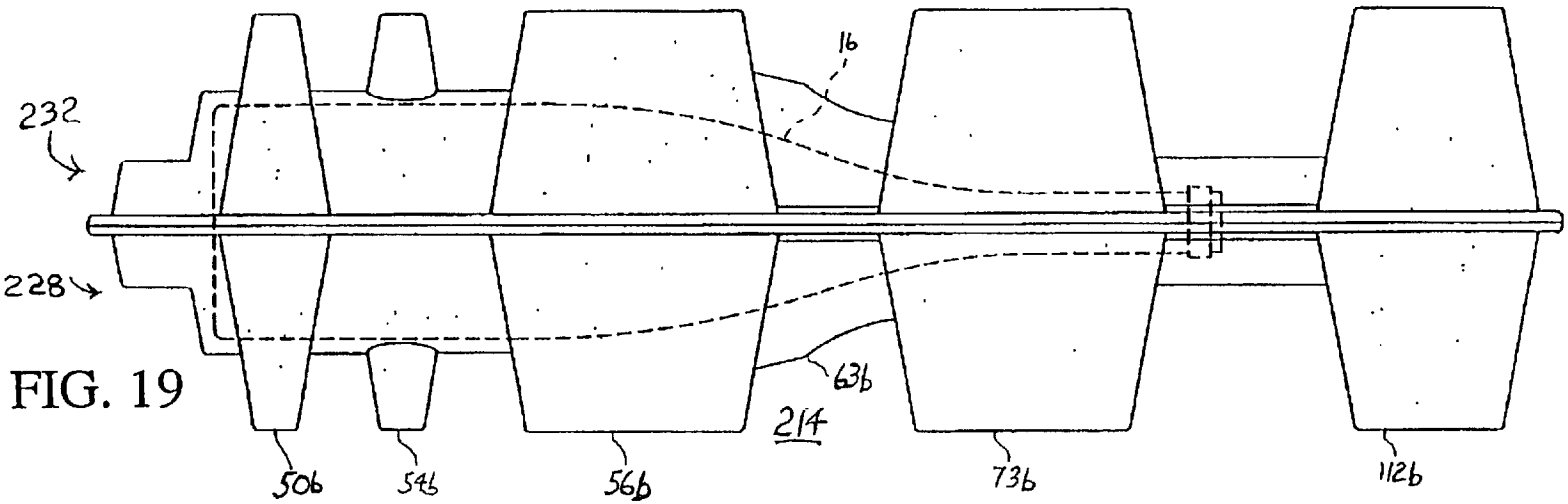
FIG. 19 is a side elevational view of the protector of FIG. 17 in the closed state.

Referring to FIG. 16 and FIG. 17, which comprise a plan view and an end view respectively of the second embodiment of the protector in an open state, the tray 214 comprises first and second bottle bays 228 and 232. Each bottle bay has features that correspond to those of bottle bays 28 and 32 of the protector of FIG. 2, with slight modifications such that bottle bay 228 is bilaterally symmetrical along line 234, which defines the center line of the bottle bay. Bottle bay 232 is bilaterally symmetrical along its center line 236. Therefore, rather than employing an elevated edge portion 59' in cradle 58, for example, the inner portion of cradle 58 is essentially a mirror image of the perimeter portion thereof, providing a symmetrical saddle shaped cradle. The other features of the bays 228 and 232 are similarly formed. The two bottle bays 228 and 232 are positioned to each receive a bottle therewithin with the bottle neck oriented in the same direction in each bay. Unlike the protector 14 of FIG. 2, protector 214 does not employ a central bottle bay for receiving a bottle therein in alternate orientation. Instead, a hinge member 230 is provided, which enables folding of the protector along the hinge member's longitudinal axis. Accordingly, by folding of the two bottle bays along the hinge member in clam-shell fashion, the protector is suitably converted into a one-bottle shipping protector. FIG. 18 is an end view of the protector 214 in a closed state, for receiving and protecting one bottle therewithin, while FIG. 19 is a side elevational view of the protector in the closed state. Protector 214 thus provides a configuration suited for shipping one, two, four and six or more bottles while requiring inventory of only one shipping protector tray. The wine dealer is accordingly provided with greater shipping flexibility without needing additional protector tray styles in inventory.

The protector may also be provided with inward step portions 238, 240 and 242, illustrated in phantom in FIG. 16, along hinge member 230. These correspond to areas 82, 86 and 90 of the protector 14 (FIG. 2) and provide spring like shock absorbing function, such that the tray flexes somewhat on along its perimeters in response to impacts and returns substantially to its original shape without structurally failing when in the folded state of FIGS. 17 and 18.

Protector 214 is also configured with a screened and textured face, with each such face having the structural members as in protector 14, enabling the protector to function with either face oriented upwardly. Further, whether in the folded configuration of FIGS. 18 and 19 or in the open configuration of FIGS. 15–17, protector 214 is adapted for multiple layer uses.

Figure 20:
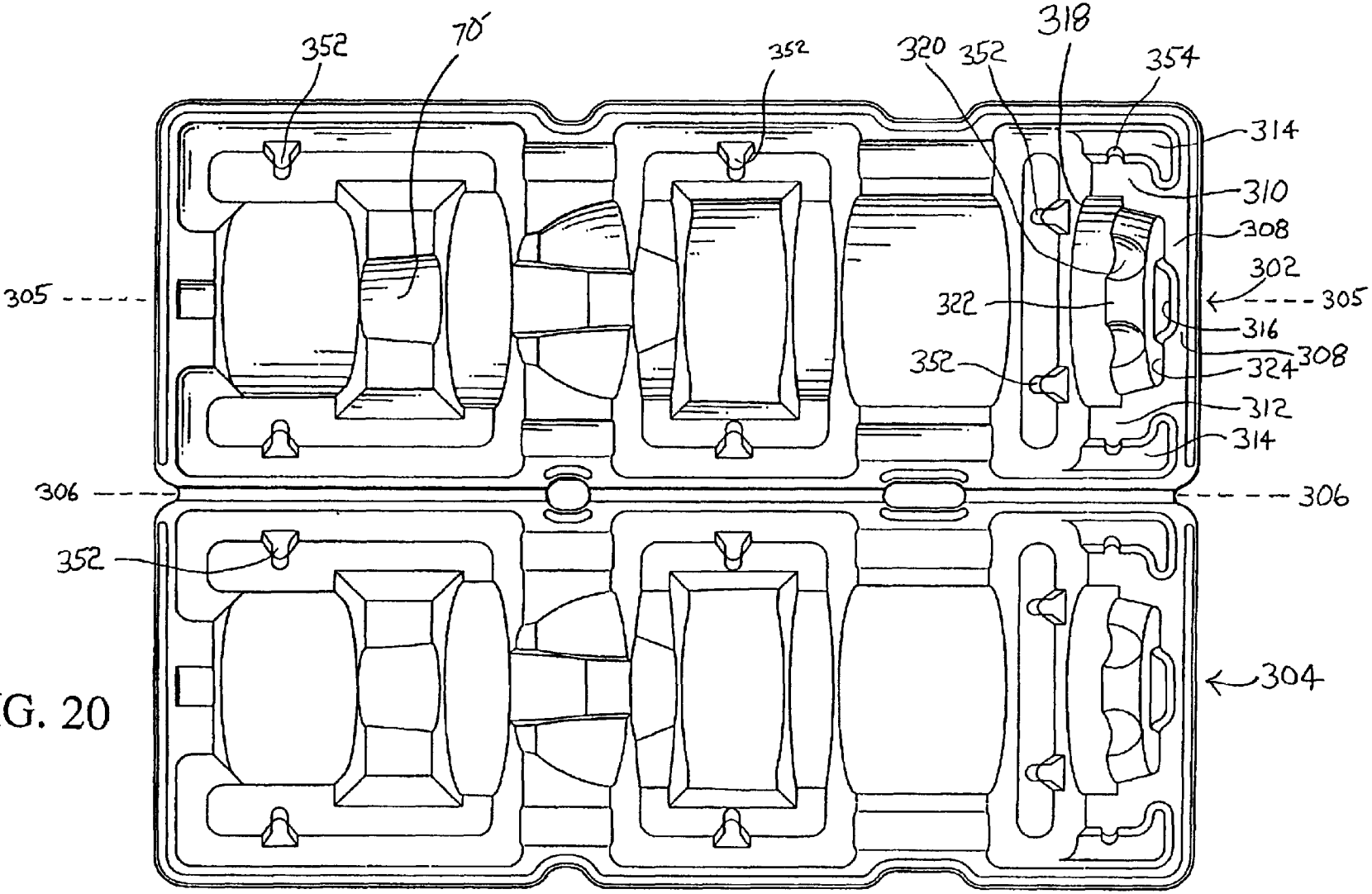
FIG. 20 is a plan view of a variable length embodiment of a protector tray.
Figure 21:
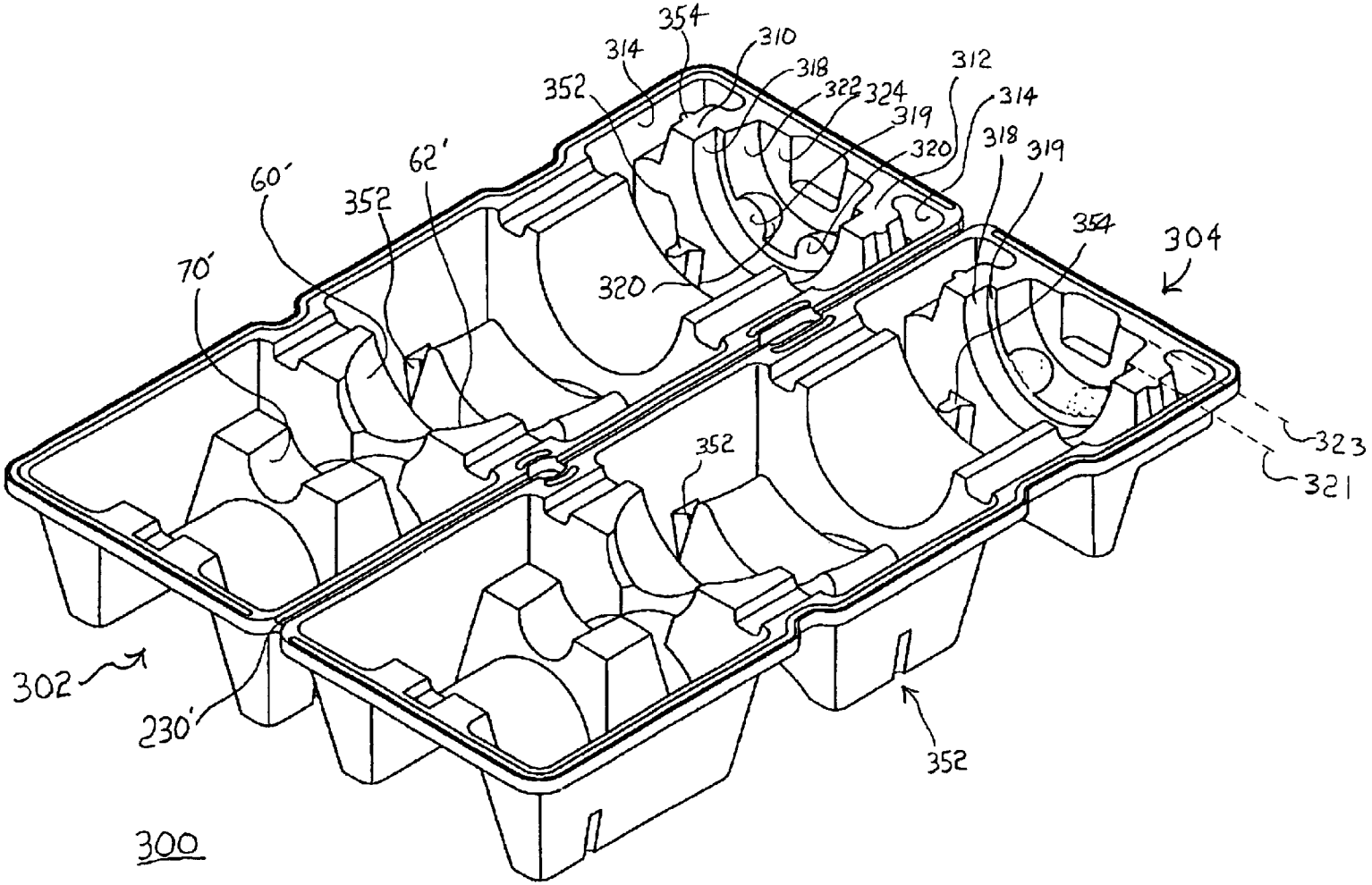
FIG. 21 is a perspective view of the tray of FIG. 20.
Figure 22:
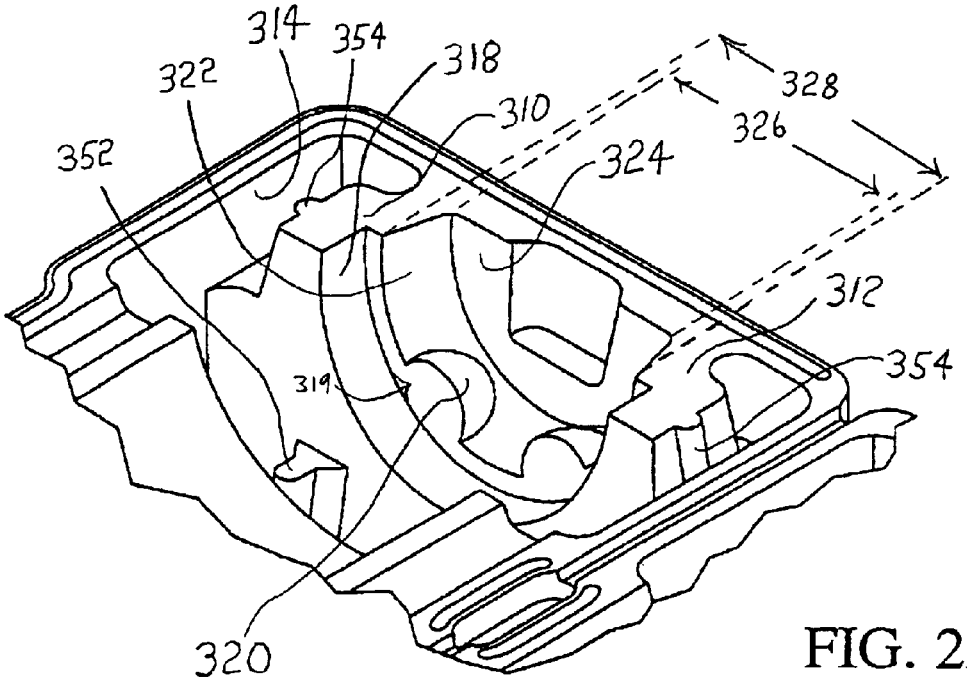
FIG. 22 is a more detailed perspective view of a portion of the bottle end receiving portion of the variable length tray embodiment.

Referring now to FIG. 20, which is a top plan view of a protector tray 300 having variable bottle length adjustment features, and to FIG. 21, a perspective view of the tray, it is observed that the tray comprises two bottle receiving bays 302 and 304 positioned side by side. The tray is bilaterally symmetrical along center line 306—306 of FIG. 20. The two bottle bays have features that correspond to each other and in the illustrated embodiment, the bays are also symmetrical down their respective centerlines 305—305, for example. The structure of the bays may be understood by considering bottle bay 302, wherein protection to the bottle against damage is provided by bottle base zone crush protector 308, which comprises first and second members 310 and 312, with shallow well portion 314 formed adjacent the sides of member 310 and member 312. A shallow well portion 316 is formed between members 310 and 312. The shallow well portions 314 and 316 extend downwardly between one fourth and one third the height of the tray (defined as the distance between the plane of the top portion of the tray and the bottom portion of the tray, suitably comprising slightly more depth than the diameter of a wine bottle). A relatively deep semi-circular bottle receiving end stop 318 is defined between members 310 and 312. The top faces of members 310 and 312 define a plane, which will bisect the body of a typical 750 ml wine bottle when the bottle is received within the tray with the bottom portion of the bottle within bottle receiving end stop 318. Accordingly, the depth from the top face of crush protector 308 and the bottom most position of end stop 318 is one half of the depth of a typical 750 ml wine bottle. The bottle bottom rests against face 319 of the end stop 318, defining the rearward limit of movement of the standard bottle with respect to the tray. Two raised cushioning stops 320 further define the stop against which the typical 750 ml wine bottle bottom will rest. Stops 320 define a portion of the flat face 319 against which the bottle rests, but are substantially semi-circular at the rearward portions thereof, and slope down into a semi-circular well 322 which is of slightly smaller diameter than well 318 at the edge adjacent well 318 and which further flares slightly so as to be of slightly decreasing diameter between the edge of well 318 and to back end stop face 324. The stops 320 are suitably shaped as a section of a conical solid having a curved taper. Referring to FIG. 22, which is an enlarged perspective view of a typical 750 ml bottle end receiving portion of the tray, the flare of the well 322 may be observed, wherein the diameter 326 of the well at its edge nearest the outer edge of the tray is less than the diameter 328 at the more inner portion.

Each bottle bay of the protector of FIGS. 20–25 has other features that correspond to those of bottle bays 228 and 232 of the two bay protector of FIG. 16. The protector of the embodiment illustrated in FIGS. 20 and 21 is not designed to have bottle receiving features on both faces of the tray. Instead, the configuration is intended to be used in a clam-shell configuration, with two trays employed face-to-face for each layer of bottles. Accordingly, the bottle neck receiving portion of the tray comprises a neck/capsule cradle 70', but does not employ, in the illustrated embodiment, a cradle corresponding to that of bottle top cradle 74. Also, a hollow corresponding to central hollow 54 is not formed in cradle 52, as it is not needed to form a bottle top stop on the other face of the tray.

The two bottle bays 302 and 304 are positioned to each receive a bottle therewithin with the bottle neck oriented in the same direction in each bay. Like the protector of FIG. 16, protector 300 does not employ a central bottle bay for receiving a bottle therein in alternate orientation, but provides a hinge 230', which enables folding of the protector along the hinge member's longitudinal axis. Accordingly, by folding of the two bottle bays along the hinge member in clam-shell fashion, the protector is suitably converted into a one-bottle shipping protector as shown by FIG. 23.

Figure 23:
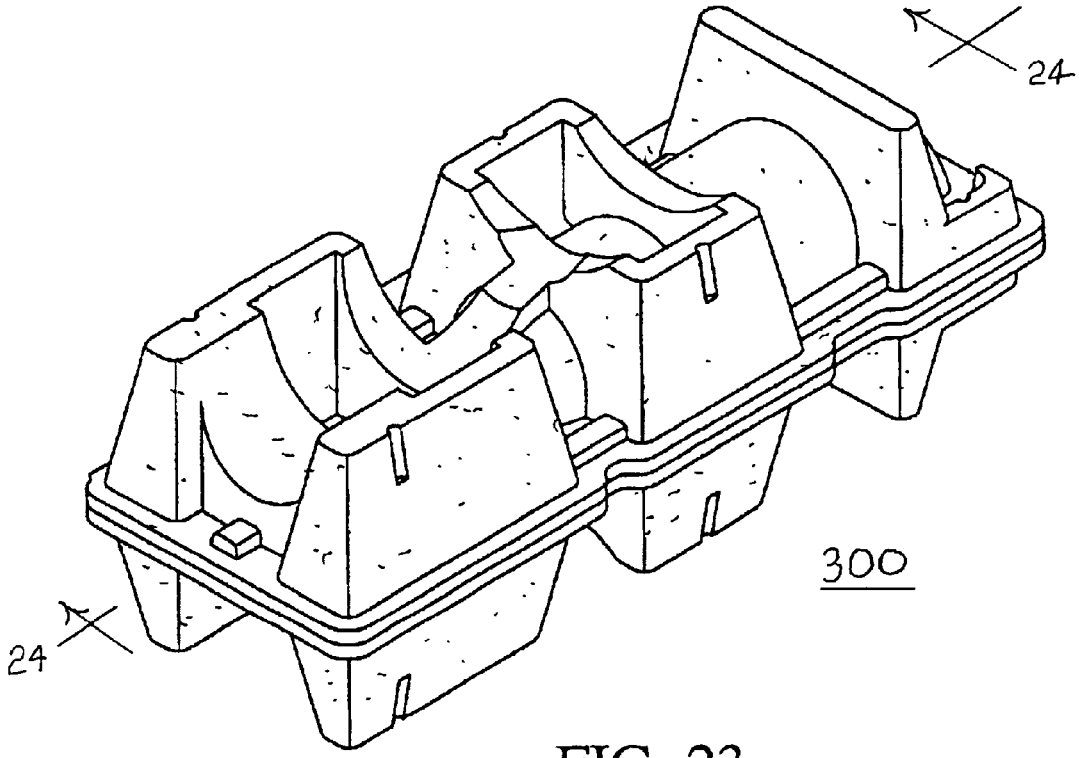
FIG. 23 is a perspective view of the tray of FIG. 20 in a one bottle configuration.
Figure 24:
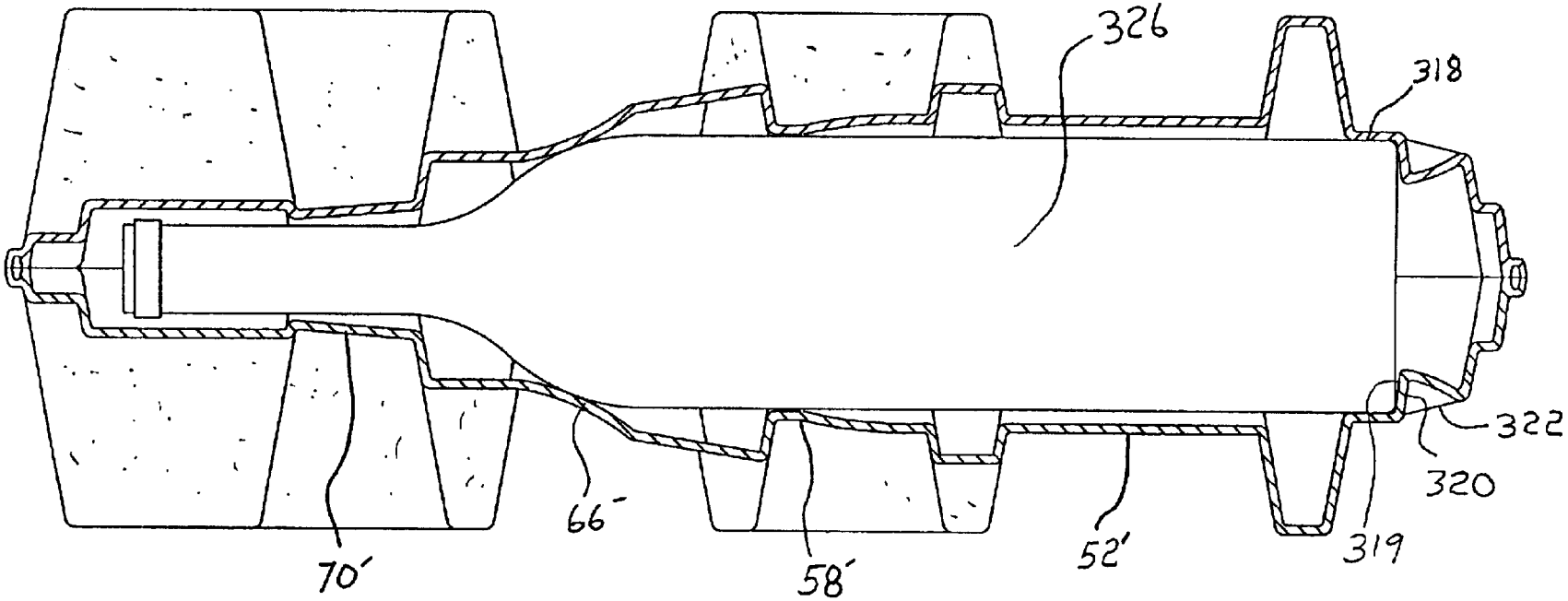
FIG. 24 is a cut away view of the tray of FIG. 23 taken along line 24—24, illustrating a shorter bottle therein.
Figure 25:
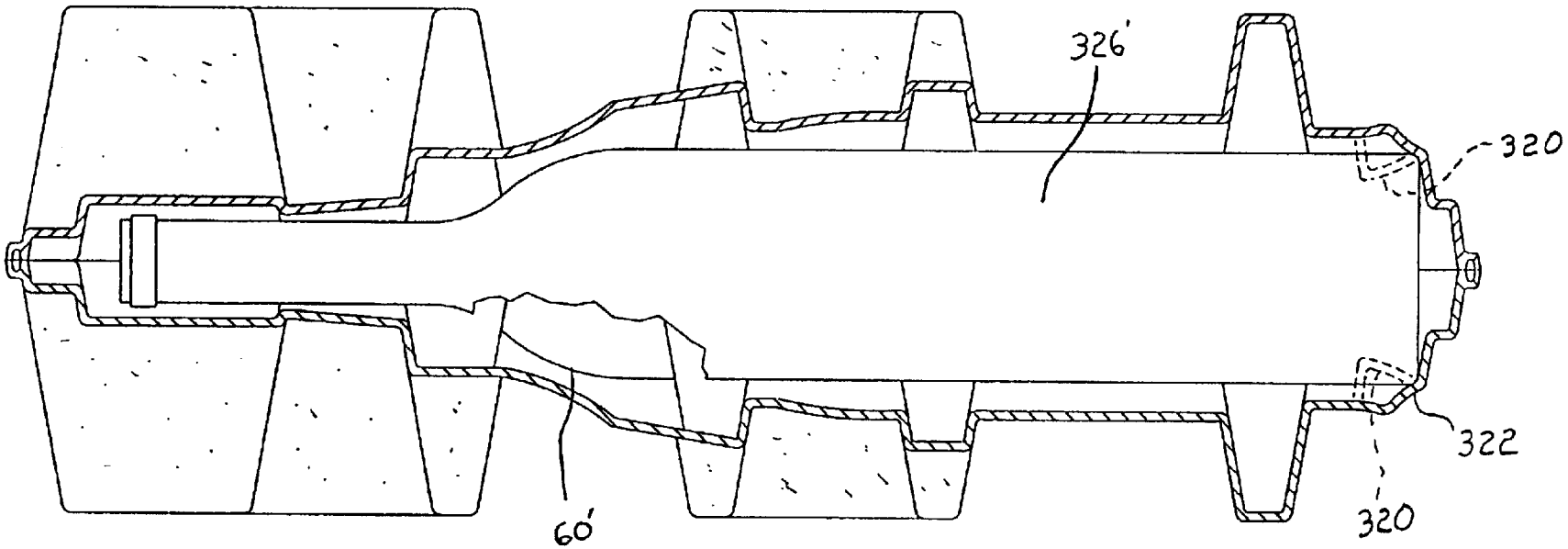
FIG. 25 is a cut away view of the tray of FIG. 23 taken 1o along line 24—24, illustrating a longer bottle therein, with a partial cut portion illustrating the interference fit between the bottle and the protector.

In use, with standard length bottles, members 320 define the stop portions for the bottom of the bottle, wherein the bottom portion of the bottle 326 rests against the inwardly oriented face 319 of stop 320, as illustrated in FIG. 24, which is a partial sectional view of a protector folded around a bottle, taken along line 24—24 of FIG. 23. Referring to FIG. 21, the position where the bottle end rests for a shorter configuration bottle is shown at 321 in FIG. 21. However, if a longer bottle 326' is to be packed, then stops 320 are depressed, as illustrated in bottle bay 304 in FIG. 21, thereby flattening them out and removing the stop face 319 that was previously formed by members 320. Semi-circular well 322 now provides an interference fit with the bottom of the bottle, the ever decreasing diameter flare adaptable for accommodating different bottle sizes, providing an interference fit with the bottle. The rearward limit of the interference fit is at the back wall 324, the position being noted by reference 323 in FIG. 21. FIG. 25, a partial sectional view of the protector of FIG. 23, with a longer bottle therein, illustrates the relative fit with a longer bottle. The area where stops 320 were originally positioned prior to their being depressed is illustrated in phantom in FIG. 25.

The bottle 326 in FIG. 24 rests with its bottom end in well 318 and against stop 320. The body of the bottle may be supported by bottle cradle 52' and secondary bottle cradle 58', depending on the specific shape. The illustrated bottle is free from engagement with cradle 52'. The bottle shoulder rests in left and right bottle shoulder cradles 60' and 62' (not visible in FIG. 24) and may further be supported by shoulder portion 66'. Depending upon the bottle configuration, the bottle neck may rest against neck/capsule cradle 70'.

Bottle 326' of FIG. 25 is substantially longer and therefore, the bottom of the bottle fits against semi-circular well 322, while the bottle shoulder is in an interference fit with the left and right shoulder cradles. The view of FIG. 25 is partially cut away to show the shoulder cradle 60', which engages with the bottle shoulder. The particular bottle configuration in FIG. 25 results in most other portions of the bottle not being in contact with the protector. Different shaped bottles are engaged by the protector at different positions, depending on the particular bottle configuration.

The cushioning stops therefore act as a buttress stop for most conventional wine bottles. However, if a bottle having a non-standard shape is to be packed, the protector is easily modified to accept the bottle. The stops provide an interference fit, but are also flexible and can provide a secondary cushion, deforming and allowing slight movement of the bottle, in the event of a severe impact to the shipping carton holding the bottle and protector therein. While the preferred embodiment employs two such depressable stops in each bottle bay, the protector is suitably manufactured with one such depressable stop per bay, or with more than two per bay.

The depressable cushioning stop of the embodiments of FIGS. 20–25 is also suitably employed in the double sided protectors of FIGS. 1–19, where face 111 of stop **110*b* on the bottom face of tray 122 (FIG. 3) is moved, for example, to provide a longer bottle bay, and stops which correspond to those of stops 320 (FIG. 20) are provided at a position coinciding with the position where stop 110*b* originally was. The bottle receiving end stop 42 on the other face of the protector (FIG. 2) is modified in a fashion to be consistent with bottle receiving end stop 318 employing one or more deformable stops 320**.

Figure 26:
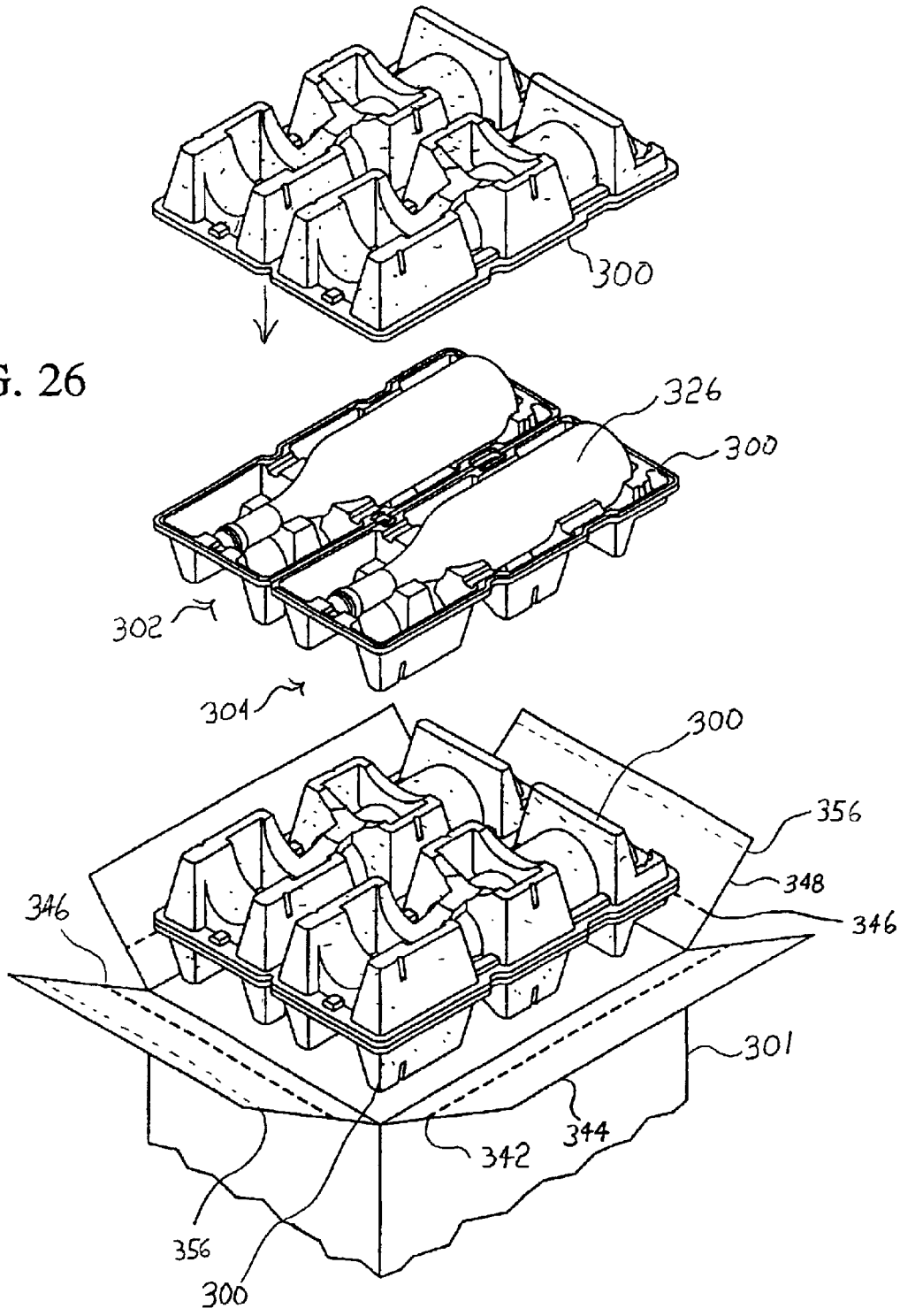
FIG. 26 is an exploded perspective view of a carton of four bottles of wine as packaged with the protector tray of FIG. 20.

FIG. 26 is an exploded perspective view of a carton 301 of four bottles of wine 326 as packaged with the protector tray 300 of FIG. 20, when employing the trays in a two bottle per layer configuration. For each layer of bottles, two trays are positioned with their interior faces towards each other, and the bottles positioned therewithin.

Figure 27:
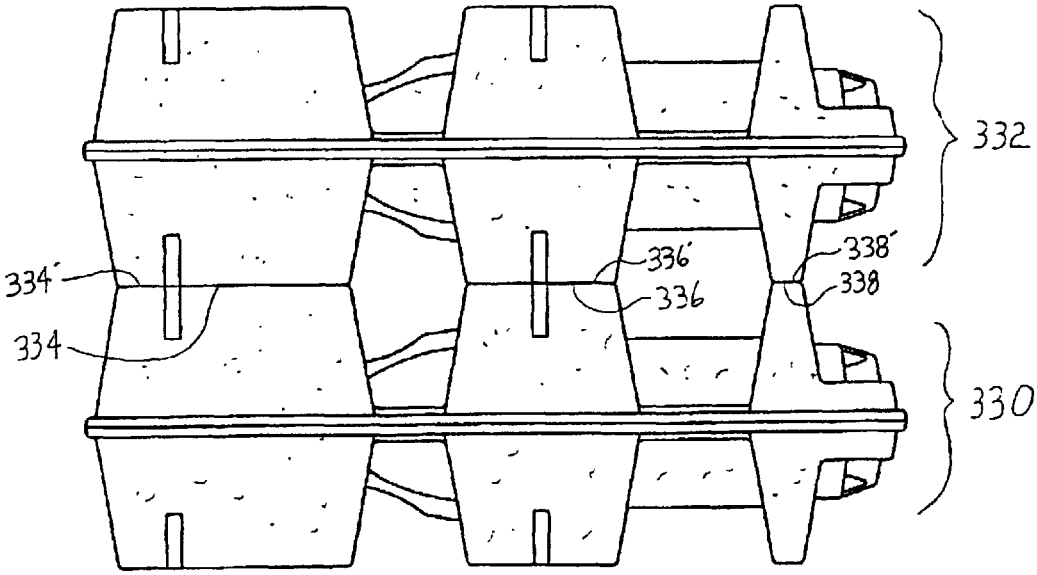
FIG. 27 is a side view of two layers of protectors stacked in a preferred manner.

Referring to FIG. 27, which is a side view of two layers of stacked protectors of FIG. 20, the preferred manner of stacking of layers within a shipping carton is displayed. The layers of trays are preferably aligned such that the various feet members 334, 336 and 338 of the top protector of a lower layer 330 associate with their corresponding feet member 334', 336' and 338' of the bottom protector of upper layer 332. Accordingly, the load forces are distributed, avoiding the potential of load being concentrated in a relatively narrow foot member causing a "knife blade" effect, wherein a narrow structure pressed against a wider structure or against a region where no corresponding foot or support member is present can puncture the wider structure or non-supported region.

Figure 28:
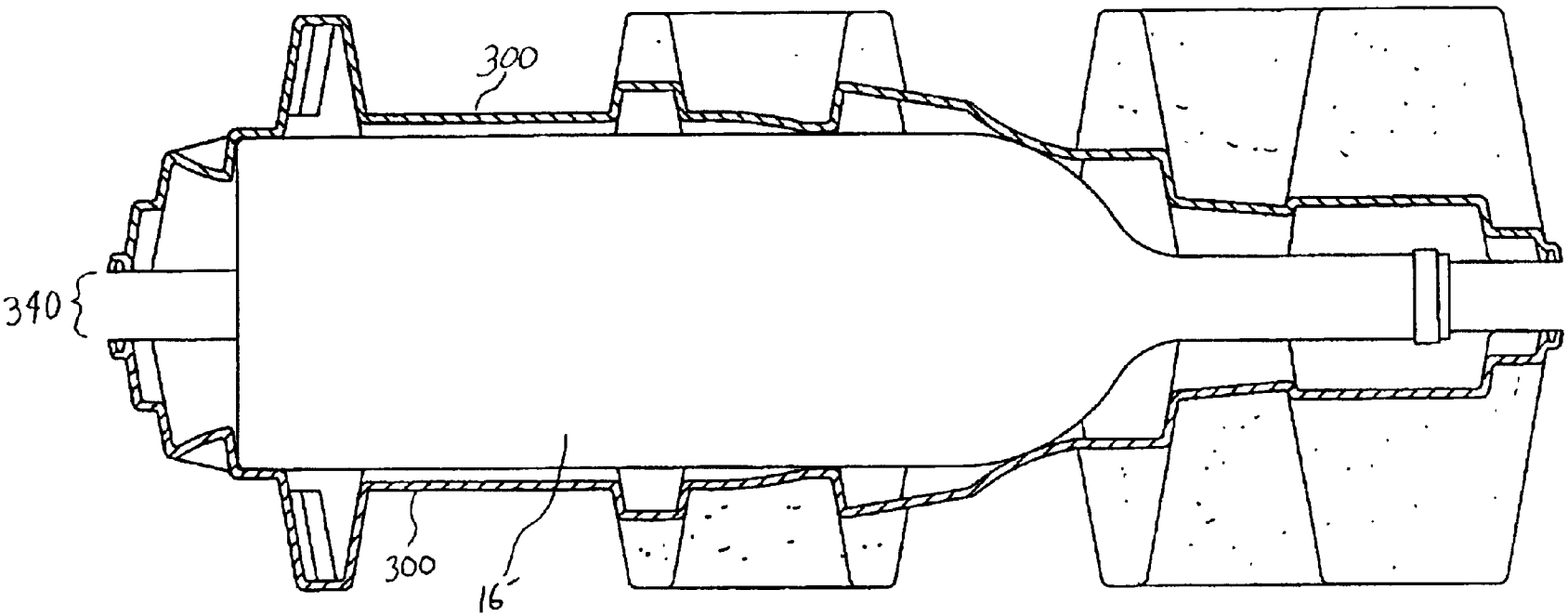
FIG. 28 is a side sectional view of a shipping protector according to the embodiment of present invention of FIG. 20, with a "fat" style wine bottle therewithin.
Figure 29:
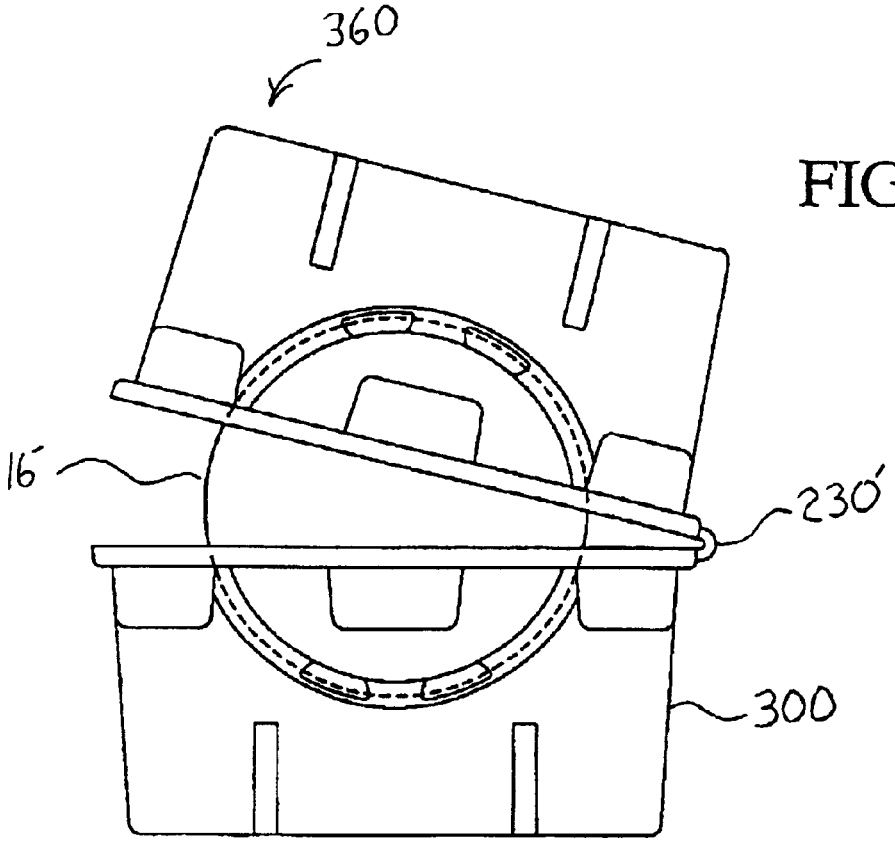
FIG. 29 is an end view of a first stage of enclosing the "fatter" champagne or punt style bottle in the protector.
Figure 30:
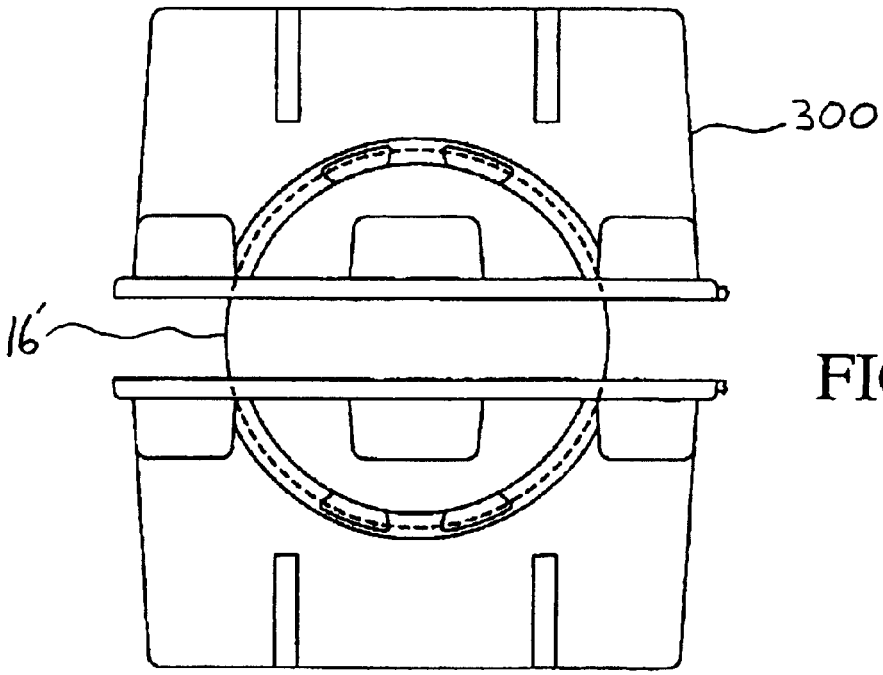
FIG. 30 is an end view of the protector of FIG. 29 after separation of the two bottle bays.

FIG. 28 is a side sectional view of a shipping protector according to the embodiment of present invention of FIG. 20, with a "fat" style wine bottle positioned therewithin in clam-shell fashion. The larger diameter bottle, for example a champagne or punt style bottle 16', fits between two halves of protector 300, but is of such a relatively large diameter that when the protector and bottle are fully engaged, a gap 340 is present, wherein the two protectors halves do not meet each other. However, the protector 300 still provides ample protection to the bottle during shipping. Only alteration to the size of the shipping carton need be made. Therefore, the shipping protector of the present invention accommodates a greater variety of bottle sizes, allowing a reduced inventory of protectors that will receive many different bottles sizes therein. When enclosing a single larger diameter bottle within a protector, the bottle is first placed within one bottle bay. The protector is then folded along the hinge member and the second bottle bay comes up to cover the top portion of the bottle. However, since the bottle is of larger diameter the two tray halves do not completely close in clam-shell fashion (see FIG. 29). To complete the packing, it is simply necessary to press downwardly in the direction of arrow 360, whereupon the two tray halves will separate along the hinge member, resulting in the two separate halves as shown in FIG. 30 and FIG. 28. Alternatively, the two tray halves may be separated by tearing them apart along hinge line 230' prior to (or after) placing the bottle in one of the halves.

Referring back to FIG. 26, the shipping carton which is used for the smaller diameter bottles can be provided with score lines 342 on side flaps 344 and score lines 346 on end flaps 348. Both sets of score lines 342 and 346 are relatively near the existing fold lines on the flaps. Thus, when a shipment is to be made of bottles of larger diameter (as in the configuration illustrated in FIG. 28), the side and end flaps are folded along the score lines 342 and 346, providing a taller carton configuration which easily accommodates the slightly taller stack of protector/bottle layers.

Figure 31:
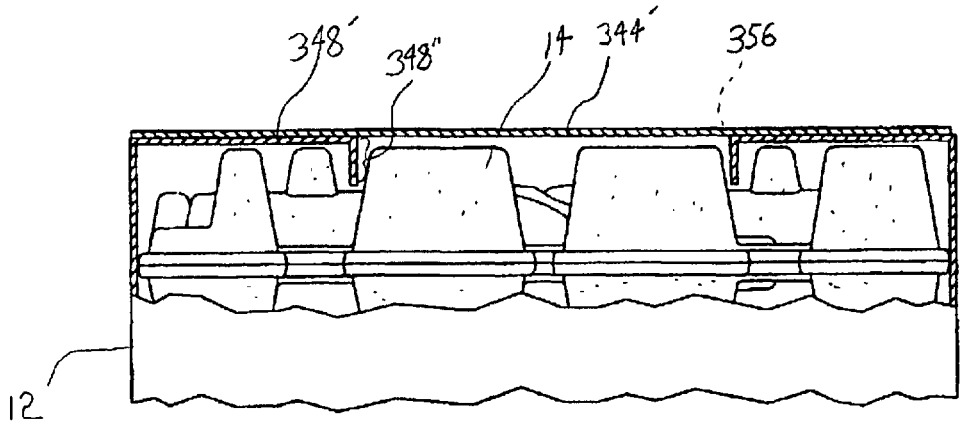
FIG. 31 is a partial sectional view of a container with a series of protectors therein, illustrating a technique for stiffening the container against movement.

Referring to FIG. 31, a partial sectional view of a container with a series of protectors therein, together with FIG. 1, a technique for stiffening the container against movement during shipping will be described. As the number of layers of protectors/bottles increases and the carton accordingly becomes taller, there may be a tendency for the package to "sway" as a result of the weight of the contents. This is even more likely in the twelve bottle configuration as illustrated in FIG. 1. Therefore, the end flaps 348' of carton 12 are provided with score lines 356 adjacent the distal ends of the flaps. Once the carton is packed and ready to be sealed, the end flaps are folded downwardly along the score lines 356, resulting in downwardly oriented flap portions 348", visible in FIG. 31. These downwardly oriented flaps suitably provide a pair of I-beam like stiffeners across the top portion of the carton, and the stiffeners engage with the upwardly extending structures of the top most protector, resulting in a stiffening effect to reduce the sway of the contents of the carton. The stiffeners also provide additional support to combat the natural compression of the protector layers which may occur in a twelve bottle package configuration. This I-beam like stiffener configuration is also suitably applied to the other embodiments of the protectors described herein.

Figure 32:
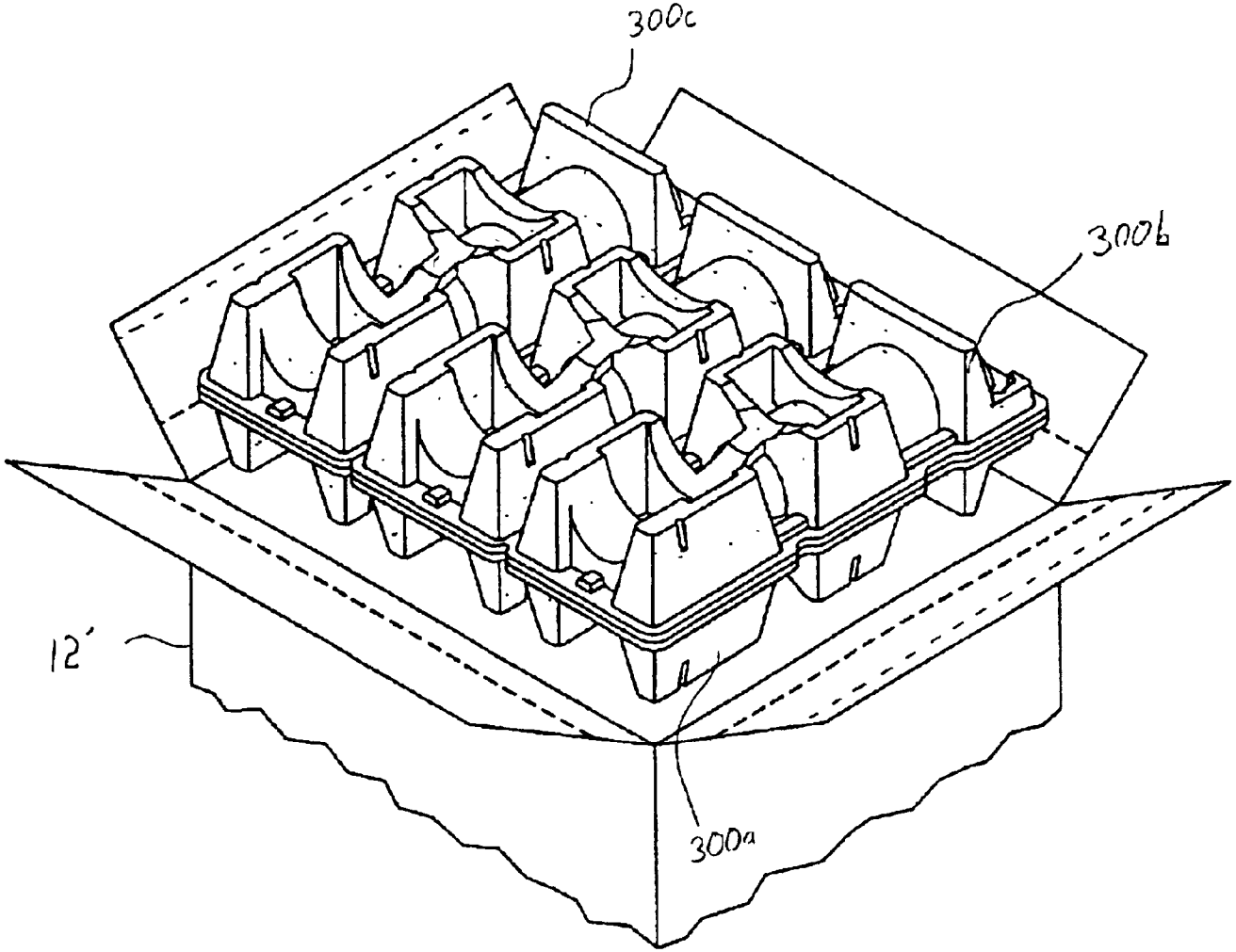
FIG. 32 is an exploded partial perspective view of a carton with three bottles of wine per layer as packaged employing an alternative configuration of the protector tray of FIG. 20.

Referring now to FIG. 32, an exploded partial perspective view of a carton with three bottles of wine per layer as packaged employing an alternative configuration of the protector trays of FIG. 20, the one/two bottle protectors 214 or 300 are suitably employed to provide a three bottle per layer shipping pack by using a first protector pair 300*a*/300*b* in a two bottle per layer configuration and positioning the two bottle tray in carton 12' adjacent a one bottle configured protector 300*c*, wherein protector 300*c* has been folded over along hinge 230' to a one bottle receiving orientation. The two bottle bay configuration tray as in FIG. 20 is therefore suitably employable for shipping one, two or three bottles per layer packages. A shipper is able to minimize the number of protectors maintained in inventory since the one tray can be used for any of the typical shipping configurations. Storage space and cost can therefore be reduced.

Referring to FIG. 20, it may be observed that the two bay protector suitably employs anti-nesting members 350 and 352, to prevent a series of stacked protectors from compacting together too tightly and thereby impeding the subsequent separation of the protectors. The anti-nesting members 352 comprise inwardly extending projections formed in the sides of the bottle bays. A set of members 352 is provided at alternate sides of the bottle bay near the neck receiving region, at alternate sides of the bottle cradle 58', and below well 318 spaced at either side of the longitudinal centerline of the bottle. A smaller pair of anti-nesting projections 354 are also provided on bottle base zone crush protector members 310 and 312. These various anti-nesting members cooperate with the corresponding members on an adjacent protector, when the protectors are stacked in nesting fashion, to provide a stop point beyond which nesting of the protectors is inhibited. Relative ease of separation of a stack of protectors is thereby assured.

The preferred material for the tray is molded pulp fiber, but other materials may be used. For example, the protector may be made of plastic or other synthetic substances.

Thus, according to the present invention, a shipping tray for bottles or other such fragile vessels is provided that comprises flexing or springing and deformable structures that absorb shock or impact, to protect a fragile bottle or the like, enabling a packaging configuration that passes ISTA Project 1A tests as well as UPS and Federal Express tests. The tray absorbs impact and dissipates energy, wherein the resilient ribbed contours flex with impact and reduce shock to levels below the damage boundaries of many products. This protection is provided not just on the first drop or other impact, but blow after blow. In the preferred embodiment, the molded fiber formulation filters and dampens vibration and provides an environmentally compatible shipping alternative to expanded polystyrene. The tray is suitably recyclable and made from 100% recycled paper fibers and is biodegradable in the natural environment. The tray accommodates multiple styles of bottles, removing the need for separate inventories of protectors for different bottle styles or lengths. The two-functional-sided configuration allows the protector to be used in either top face up or top face down orientations, and provides a single piece packaging insert, removing the need for separate A/B/C piece type protectors. Accordingly, a shipping protector is provided that protects the value of products as they move through the transportation environment.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A wine bottle shipping tray for receiving and protecting a wine bottle during shipping in a carton comprising:

a first bottle receiving portion on a first side of said shipping tray for receiving a wine bottle therein;

wherein said first bottle receiving portion includes a first shoulder abutting member for abutting against a shoulder portion of the wine bottle, said shoulder abutting member comprising first and second concave up shoulder cradle members in spaced relation to one another for receiving first and second portions of the bottle shoulder, a gap being defined between a lower region of said first shoulder cradle member and a lower region of said second shoulder cradle member and a saddle member defined in the gap between said first and second shoulder cradle members for urging a second wine bottle out of a first plane of the shipping tray as said second bottle moves in a direction across said saddle member.

2. A wine bottle shipping tray according to claim 1 wherein said first plane is defined relative to a second side of said shipping tray.

3. A wine bottle shipping tray according to claim 1 wherein said first bottle receiving portion is located on a first side of the tray and wherein said tray includes a second side comprising:

a second bottle receiving portion oriented to receive a wine bottle therein in a non-coplanar relation relative to a bottle received in said first bottle receiving portion.

4. A wine bottle shipping tray according to claim 3 wherein said second bottle receiving portion is aligned to receive a bottle with a neck portion of a bottle as received by said second bottle receiving portion being oriented substantially 180 degrees out of phase relative to a neck portion of a bottle as received by said first bottle receiving portion.

5. A wine bottle shipping tray according to claim 1 further comprising a perimeter stiffener portion extending along at least a portion of the perimeter of the tray.

6. A wine bottle shipping tray according to claim 5 further comprising flexing means positioned adjacent at least portions of the perimeter for flexing under shock for absorbing said shock while maintaining the integrity of the perimeter portion.

7. A wine bottle shipping tray according to claim 1 wherein said first bottle receiving portion comprises at least one arcuate rib member defining a concavity for receiving the bottle therein.

8. A wine bottle shipping tray according to claim 7 wherein said rib member has a well formed therein extending away from a first plane of the shipping tray in a direction away from the bottle, said well defining a bottle top stop member on a second face of the tray.

9. A wine bottle shipping tray according to claim 8 wherein said well further defines a support foot at the second side of said tray for providing support to said tray relative to a planar surface.

10. A wine bottle shipping tray according to claim 7 wherein said rib member has a valley formed adjacent thereto, said valley defining a rib portion on the second side of the tray.

11. A wine bottle shipping tray according to claim 1 further comprising at least one progressively failing shock absorber positioned between a perimeter of the tray and said first stop means.

12. A wine bottle shipping tray according to claim 1 wherein said tray comprises molded fiber.

13. A shipping protection arrangement employing at least two wine bottle shipping trays according to claim 3 comprising:

a first one of said at least two wine bottle shipping trays positioned with one of said first or second sides adjacent a wine bottle in either said first or second wine bottle receiving portion of said first tray; and a second one of said at least two wine bottle shipping trays positioned with one of said first or second sides adjacent the wine bottle in either said first or second wine bottle receiving portion of said second tray.

14. A wine bottle shipping tray according to claim 1 further comprising at least one anti-nesting member for preventing excessive nesting of the shipping tray relative to a second shipping tray.

15. A wine bottle shipping tray according to claim 3 wherein said saddle member comprises a hump member which corresponds to a region of change of inflection in said saddle member.

16. A wine bottle shipping tray according to claim 1, wherein said saddle member comprises a concave down saddle member.

17. A wine bottle shipping tray according to claim 1, further comprising a variable position stop for enabling adjustment of the location of a bottle stop point and wherein said variable position stop comprises a removable member, which is adapted to be deformed so as to be out of an engaging position with a bottle bottom wall.

18. A wine bottle shipping tray for receiving and protecting wine bottles during shipping in a carton comprising:

a first concave up shoulder cradle member;

a second concave up shoulder cradle member, said first and second should cradle members being in spaced relation to one another for receiving first and second portions of a shoulder portion of a first wine bottle, a trough being defined between a lower region of said first shoulder cradle member and a lower region of said second shoulder cradle member; and a concave down saddle member defined in the trough between said first and second shoulder cradle members for urging a second wine bottle out of a first plane of the shipping tray as said bottle moves in a direction substantially parallel to a longitudinal axis of the wine bottle.

19. A wine bottle shipping tray for receiving and protecting wine bottles during shipping comprising:

a bottle shoulder receiving cradle having left and right side curved bottle shoulder receiving portions for receiving and cradling a first wine bottle therein, a spaced region between said left and right side portions defining an absence of said bottle receiving shoulder portions;

a bottle shoulder engaging member positioned in the spaced region having a portion for contacting a shoulder portion of a second wine bottle.

20. A wine bottle shipping tray according to claim 19, wherein said bottle shoulder engaging portion is curved with an opposite concavity of said bottle shoulder receiving cradle.

21. A bottle shipping protector having a first and second faces at opposite sides thereof, for engaging and protecting plural bottles during shipping, comprising:

at least one arcuate cradle member for receiving a bottle body portion therein at a first face of said shipping protector;

a hollow member formed in said arcuate cradle member, extending away from said cradle member in a direction away from said first face, wherein said hollow member thereby defines a bottle top stop member at said second face, said bottle top stop member providing a surface against which a top face of a bottle will engage to inhibit movement of the bottle in a lateral direction beyond said stop member.

22. A bottle shipping protector according to claim 21, wherein said bottle shipping protector is formed of molded fiber.

23. A bottle shipping protector according to claim 21, wherein said hollow member is formed as a tapered well in said cradle member.

24. A bottle shipping protector according to claim 21, wherein said hollow member further operates as a foot member relative to said second face.

25. A bottle shipping protector having a first and second faces at opposite sides thereof, for engaging and protecting plural bottles during shipping, comprising:

at least one bottle receiving member for receiving a bottle body portion therein at a first face of said shipping protector;

a hollow well member formed in said shipping protector relative to the first face thereof and extending in a direction away from said first face toward said second face, wherein said hollow well member defines a bottle top stop member at said second face, said bottle top stop member providing a surface against which a top face of a bottle will engage to inhibit movement of the bottle in a lateral direction beyond said stop member.

26. A bottle shipping protector according to claim 25, wherein said bottle shipping protector is formed of molded fiber.

27. A bottle shipping protector according to claim 25, wherein said hollow well member is formed in said at least one bottle receiving member.

28. A bottle shipping protector according to claim 25, wherein said hollow well member further operates as a foot member relative to said second face.

29. A bottle shipping protector having an upper and lower face, for engaging and protecting plural bottles during shipping, comprising:

a bottle receiving portion defined relative to the upper face for receiving a bottle body portion of a first bottle therein;

a bottle receiving portion defined relative to the lower face for receiving a bottle body portion of a second bottle therein;

a downwardly extending well portion formed relative to said upper face defining a stop member relative to said lower face, said bottle top stop member providing a surface against which a topmost portion of the second bottle will engage to inhibit movement of the second bottle beyond said surface in a lateral direction relative to the length of the bottle.

30. A bottle shipping protector according to claim 29, wherein said bottle shipping protector is formed of molded fiber.

31. A bottle shipping protector according to claim 29, wherein said well member is formed as a hollow in said bottle receiving portion.

32. A bottle shipping protector according to claim 29, wherein said well member further operates as a foot member relative to said lower face.

33. A bottle shipping protector according to claim 29, wherein said bottle receiving portion comprises:

a bottle end receiving portion for cooperating with the bottom end of said first bottle;

a bottle central receiving portion for cooperating with a central region of a body of said first bottle;

a bottle shoulder receiving portion for cooperating with a shoulder region of said first bottle; and a bottle top receiving portion for cooperating with a top region of said first bottle.

34. A bottle shipping protector according to 33, further comprising a channel member extending beyond an end of said bottle top cradle in a direction away from said bottle receiving portion.

35. A bottle shipping protector according to claim 29, wherein said bottle receiving portion comprises:

a bottle top cradle for cooperating with a top region of said first bottle; and a channel extending beyond an end of said bottle top cradle in a direction away from said bottle receiving portion.

* * * * *